US011824309B2

(12) United States Patent
Abouismail

(10) Patent No.: US 11,824,309 B2
(45) Date of Patent: Nov. 21, 2023

(54) DEVICE AND METHOD FOR LOCKING ELECTRICAL PLUGS TO POWER OUTLETS

(71) Applicant: Mohamed Abouismail, New Cairo (EG)

(72) Inventor: Mohamed Abouismail, New Cairo (EG)

( * ) Notice: Subject to any disclaimer, the term of this patent is extended or adjusted under 35 U.S.C. 154(b) by 0 days.

(21) Appl. No.: 16/490,605

(22) PCT Filed: May 7, 2018

(86) PCT No.: PCT/EG2018/000006
§ 371 (c)(1),
(2) Date: Sep. 15, 2020

(87) PCT Pub. No.: WO2018/206071
PCT Pub. Date: Nov. 15, 2018

(65) Prior Publication Data

US 2021/0111518 A1 Apr. 15, 2021

(51) Int. Cl.

| | |
|---|---|
| ***H01R 13/639*** | (2006.01) |
| ***H01R 13/05*** | (2006.01) |
| ***H01R 13/193*** | (2006.01) |
| ***H01R 13/447*** | (2006.01) |

(52) U.S. Cl.
CPC ..... *H01R 13/6395* (2013.01); *H01R 13/05* (2013.01); *H01R 13/193* (2013.01); *H01R 13/447* (2013.01)

(58) Field of Classification Search
CPC ..... H01R 13/6395; H01R 13/639; H01R 13/629; H01R 13/62; H01R 13/02; H01R 13/04; H01R 13/05; H01R 13/193; H01R 13/15; H01R 13/447; H01R 13/44
USPC ..... 439/373
See application file for complete search history.

(56) References Cited

U.S. PATENT DOCUMENTS

| | | | |
|---|---|---|---|
| 1,957,773 | A | 5/1934 | Good |
| 2,016,755 | A | 10/1935 | Spracher |
| 2,709,198 | A | 5/1955 | Holtshouser |
| 2,771,590 | A | 11/1956 | Nauslar |
| 2,987,909 | A | 6/1961 | Shlank |
| 3,066,276 | A | 11/1962 | Harvey |

(Continued)

FOREIGN PATENT DOCUMENTS

| | | | |
|---|---|---|---|
| CN | 201667452 | U | 12/2010 |
| CN | 202737177 | U | 2/2013 |
| EP | 2639895 | A1 | 9/2013 |

*Primary Examiner* — Harshad C Patel

(57) ABSTRACT

The present invention comprises a method and a device for connecting and locking electrical plugs into power outlets. This prevents plugs from being shaken or accidentally withdrawn, and hence avoids any disturbance of electric current or occurrence of electric spark which may cause fires. In the case where no plug is plugged in, the current invention blocks the socket openings to prevent children from tampering with it or trying to insert any metal objects therein that might expose them to electric shocks. By this invention, an adult can connect and lock electrical plugs easily while it is impossible doing it by children. There are various embodiments of this invention making it suitable for use in many fields that need a continuous electrical feed without interruption such as medical devices, computers, factory equipment, and home appliances among many other examples.

14 Claims, 14 Drawing Sheets

(56) References Cited

U.S. PATENT DOCUMENTS 3,121,599 A 2/1964 Modrey
3,159,446 A 12/1964 Protzmann
3,233,204 A 2/1966 De Vore, Jr.
3,467,763 A 9/1969 Shaw
3,491,327 A 1/1970 Tait
3,775,729 A 11/1973 Casper
3,891,289 A * 6/1975 Hanke ..... H01R 13/20 439/106
4,584,856 A 4/1986 Petersdorff
4,603,931 A 8/1986 Ruffman
4,652,069 A 3/1987 Smith
4,674,813 A 6/1987 Feldner
4,702,709 A 10/1987 Santilli
4,851,612 A 7/1989 Peckham
5,061,199 A 10/1991 McClead
5,194,013 A 3/1993 Propp
5,286,213 A * 2/1994 Altergott ..... H01R 13/4532 200/51.09
5,344,333 A 9/1994 Haag
5,348,495 A 9/1994 Kasden
5,352,132 A * 10/1994 O'Keefe ..... H01R 13/20 439/346
5,413,498 A * 5/1995 Ursich ..... H01R 13/6276 439/346
5,454,729 A * 10/1995 Wen-Te ..... H01R 13/6273 439/357
5,551,884 A * 9/1996 Burkhart, Sr. ..... H01R 13/20 439/140
5,575,677 A 11/1996 Buckner
5,599,196 A 2/1997 Powell
5,655,924 A 8/1997 Cross
5,791,931 A * 8/1998 Burkhart, Sr. ..... H01R 13/20 439/304
5,893,772 A * 4/1999 Carmo ..... H01R 13/639 439/346
5,921,799 A * 7/1999 Forrester ..... H01R 13/633 439/346
5,941,724 A * 8/1999 Reed ..... H01R 4/5091 439/346
5,944,542 A * 8/1999 Lee ..... H01R 13/4538 439/140
6,071,142 A 6/2000 Blackman
6,095,846 A 8/2000 Becerra
6,108,178 A 8/2000 Beadles
6,171,129 B1 * 1/2001 Phillips ..... H01R 13/193 439/263
6,193,539 B1 * 2/2001 Chang ..... H01R 13/6278 439/346
6,198,046 B1 3/2001 Moodie
6,358,076 B1 3/2002 Haag
6,454,576 B1 9/2002 Hedrick
6,479,749 B1 11/2002 Vrame
6,491,539 B1 12/2002 Johnston
6,533,598 B1 3/2003 Bentley
6,537,089 B1 3/2003 Montague
6,674,003 B1 1/2004 Torres
6,676,428 B2 * 1/2004 Burton ..... H01R 4/489 439/265
6,769,930 B1 8/2004 McDevitt, Jr.
6,780,031 B1 8/2004 Valls
6,908,502 B2 6/2005 Wireman
7,014,493 B1 3/2006 Battard
7,056,145 B2 6/2006 Campbell, III
7,077,683 B1 * 7/2006 Ross ..... H01R 13/20 439/346
7,080,889 B2 7/2006 Ling
7,156,682 B1 1/2007 Lai
7,172,451 B1 2/2007 Ratzlaff
7,347,708 B1 * 3/2008 Huang ..... H01R 13/639 439/263
7,361,045 B1 4/2008 Vinciguerra
7,381,067 B2 * 6/2008 Sze ..... H01R 27/00 439/131
7,445,513 B1 * 11/2008 Lee ..... H01R 31/06 439/131
7,484,986 B1 * 2/2009 Wu ..... H01R 13/6275 439/346
7,652,210 B2 1/2010 White
7,722,380 B1 5/2010 West
7,798,838 B2 9/2010 Grieff
8,142,208 B2 * 3/2012 Ruffner ..... H01R 27/00 439/105
8,152,554 B2 4/2012 Chapel
8,382,493 B2 * 2/2013 Ruffner ..... H01R 27/00 439/105
8,382,507 B2 * 2/2013 Yamaguchi ..... H01R 24/20 439/369
8,753,149 B2 * 6/2014 Lee ..... H01R 13/4534 439/653
9,312,625 B2 * 4/2016 Shen ..... H01R 24/78
9,548,574 B2 * 1/2017 Hsu ..... H01R 13/7038
2002/0118498 A1 8/2002 Nordling
2003/0207606 A1 11/2003 Ho
2005/0101169 A1 5/2005 Ratcliffe
2005/0124200 A1 6/2005 Nudd
2005/0186828 A1 8/2005 Burton
2007/0256850 A1 11/2007 Hansen
2009/0061667 A1 3/2009 Grieff
2010/0144187 A1 6/2010 Chapel
2010/0255708 A1 10/2010 Hsu
2013/0183855 A1 7/2013 Warner

* cited by examiner

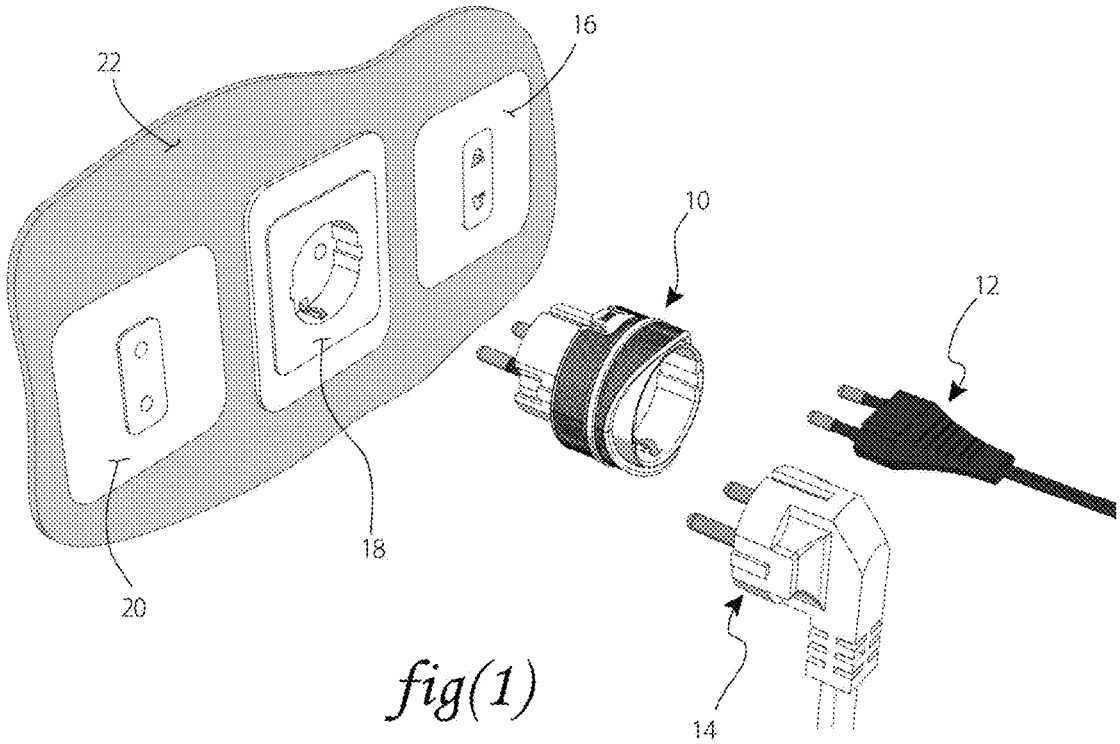
fig(1)
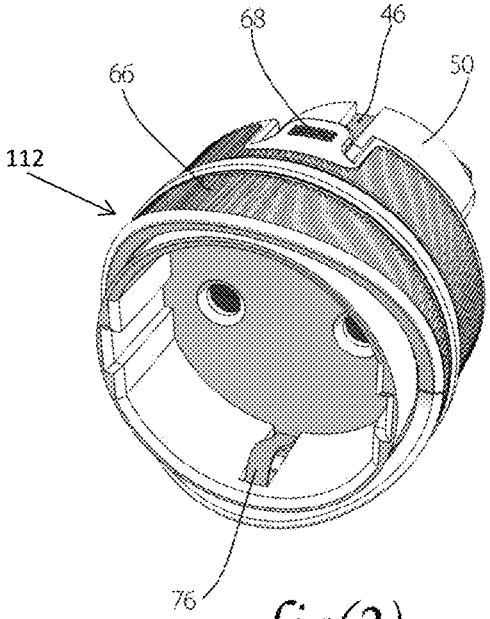
fig(2)
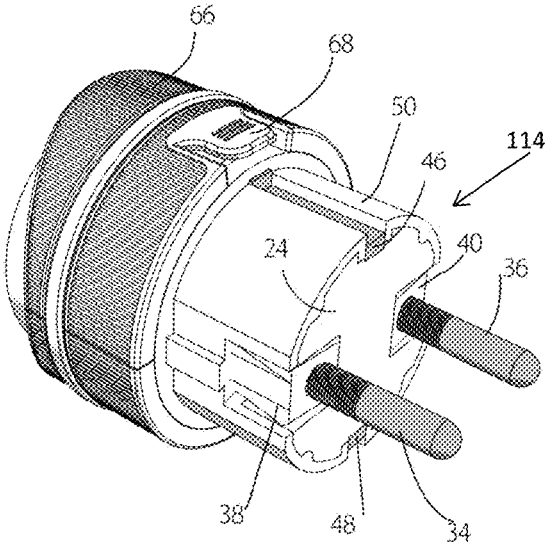
fig(3)

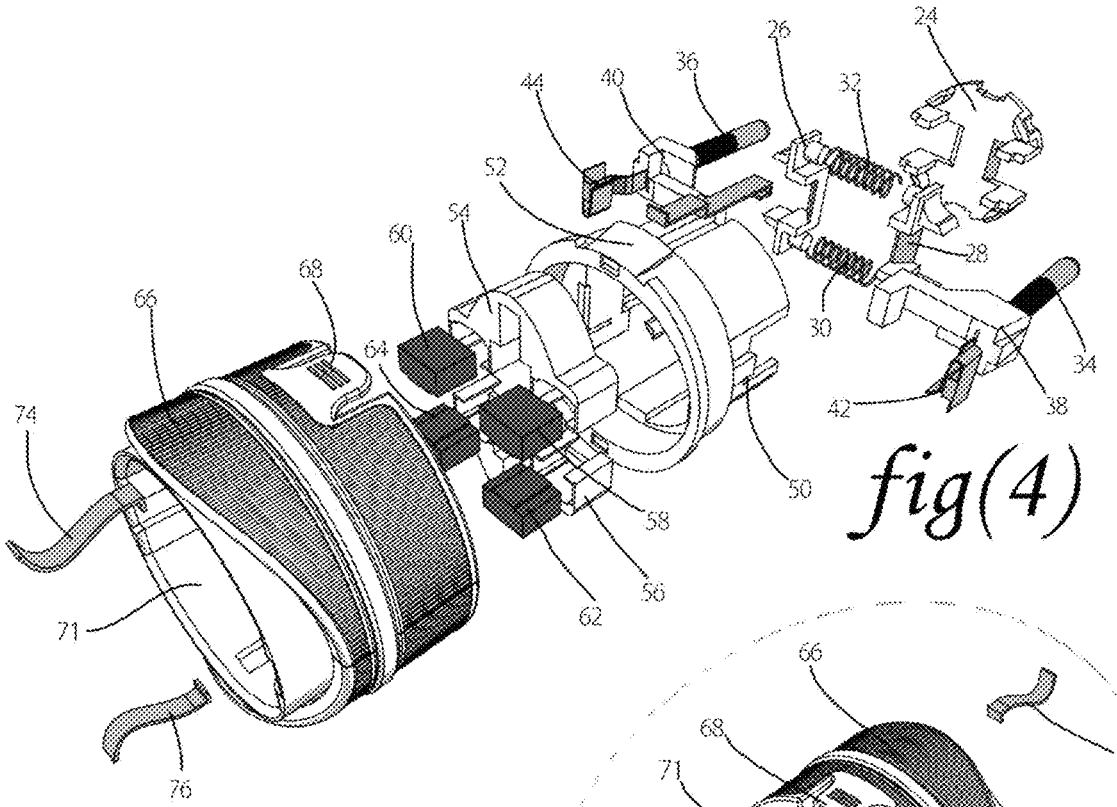
fig(4)
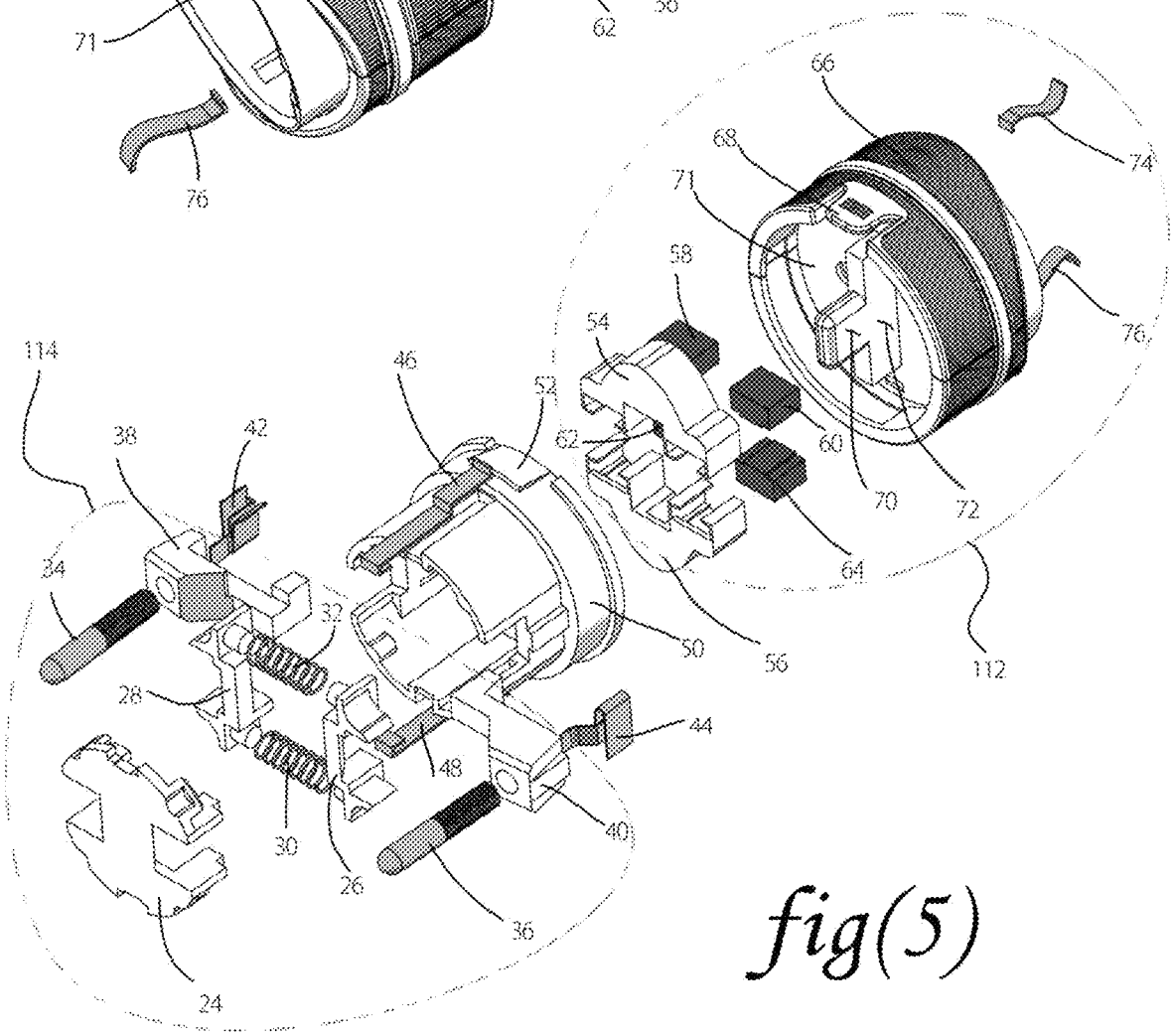
fig(5)

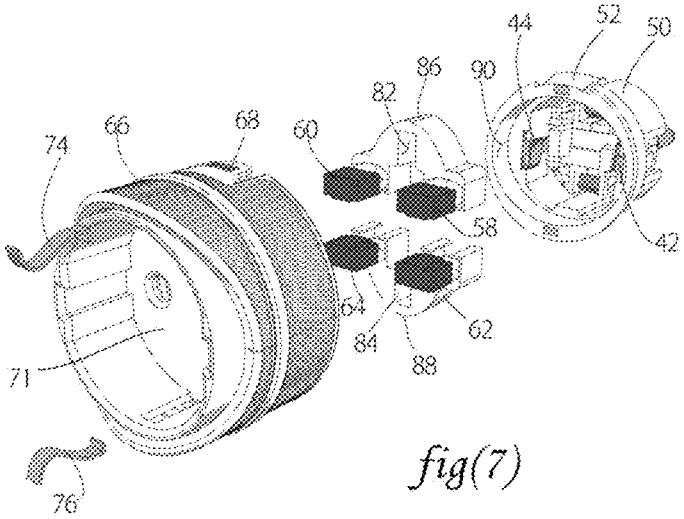
fig(7)
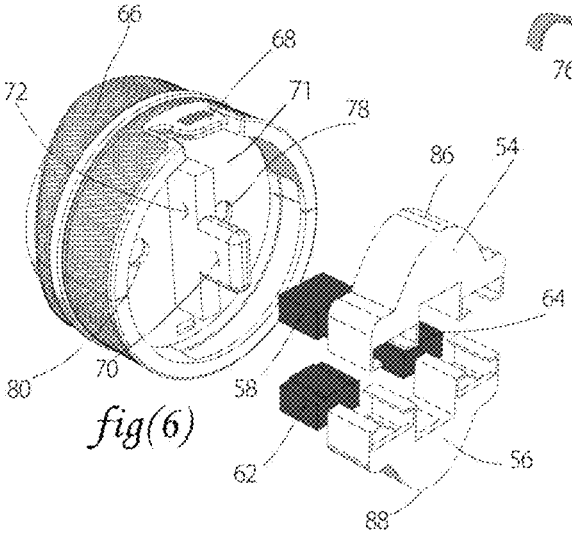
fig(6)
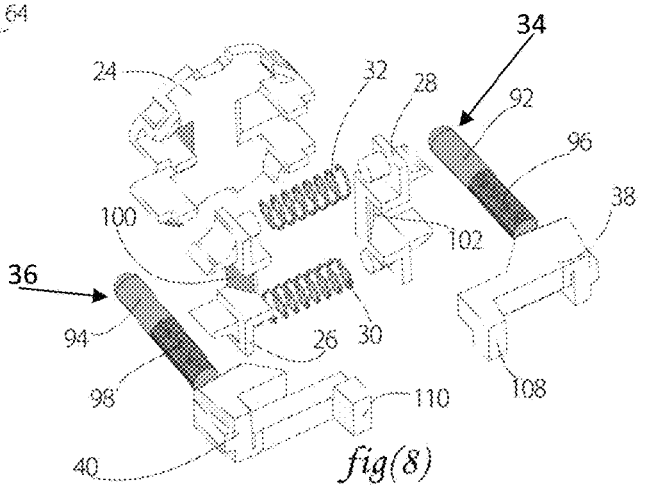
fig(8)
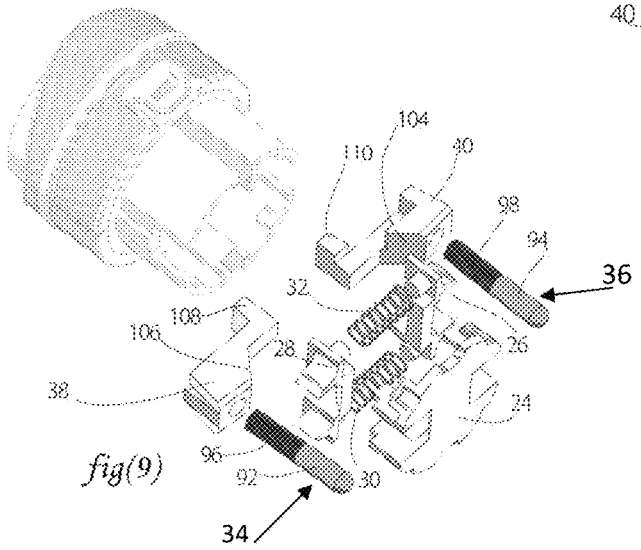
fig(9)

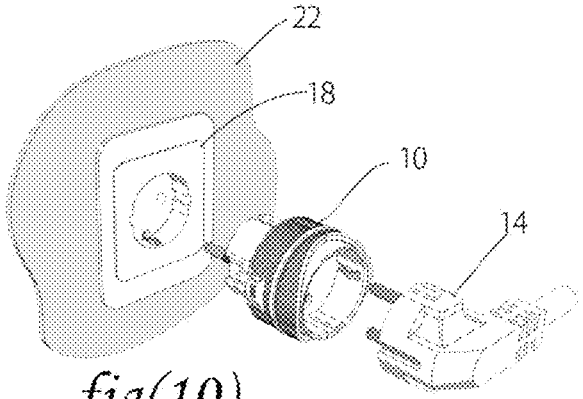
fig(10)
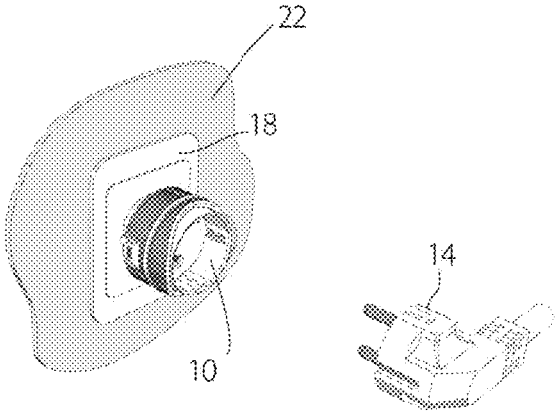
fig(11)
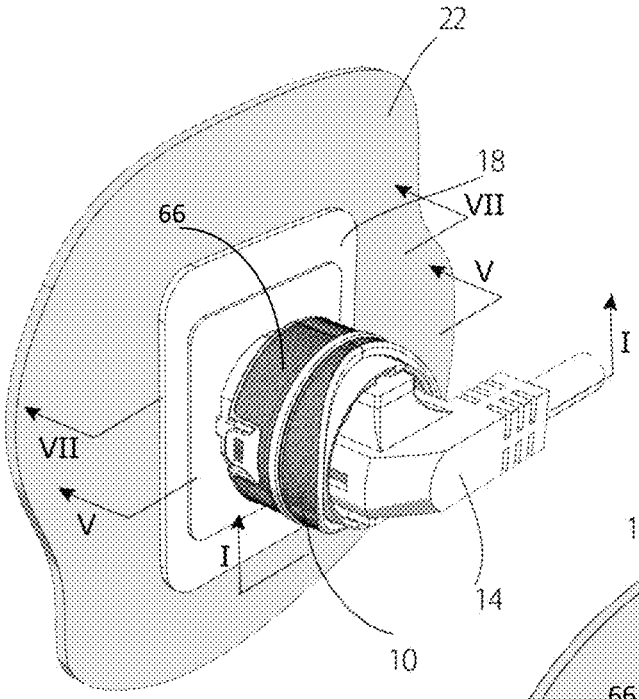
fig(12)
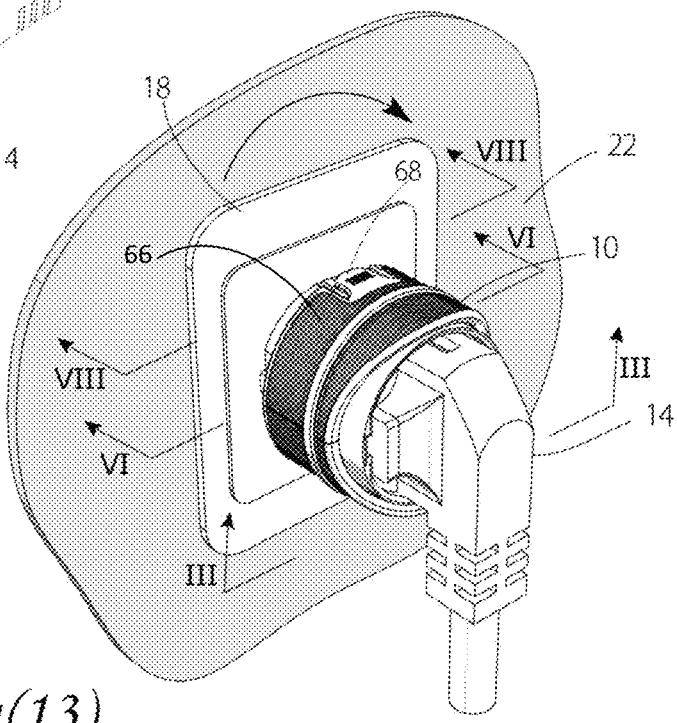
fig(13)

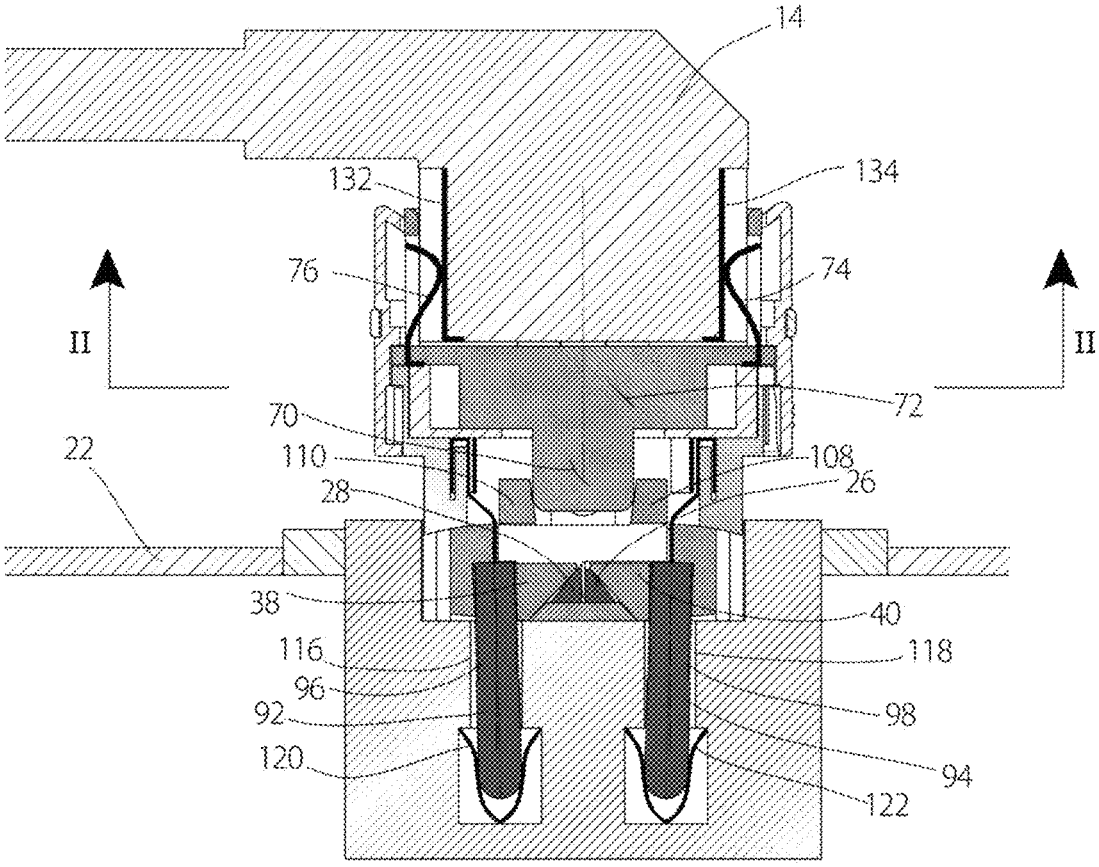
fig(14)
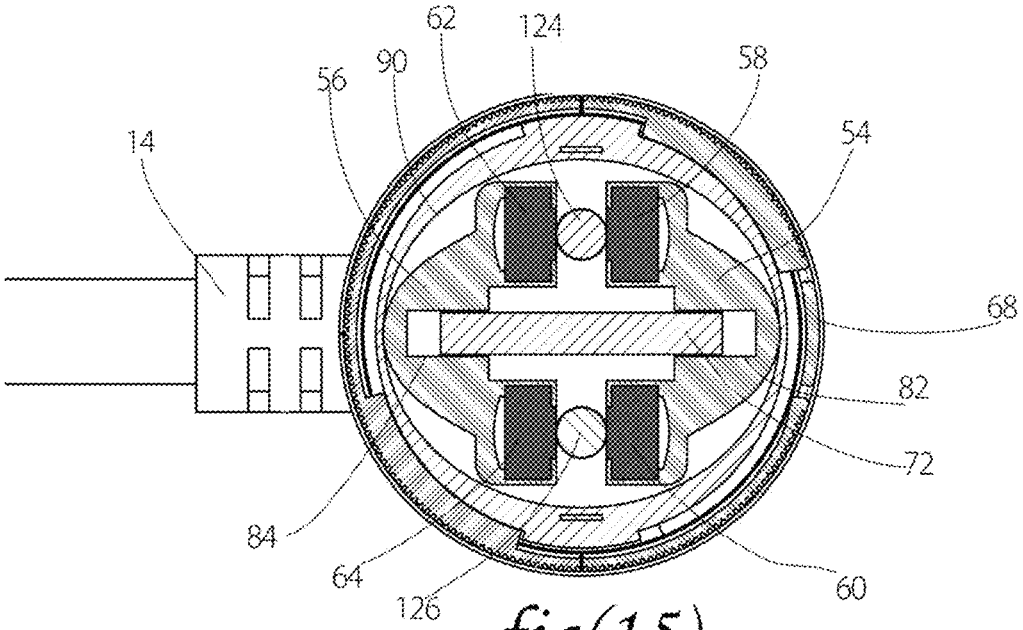
fig(15)

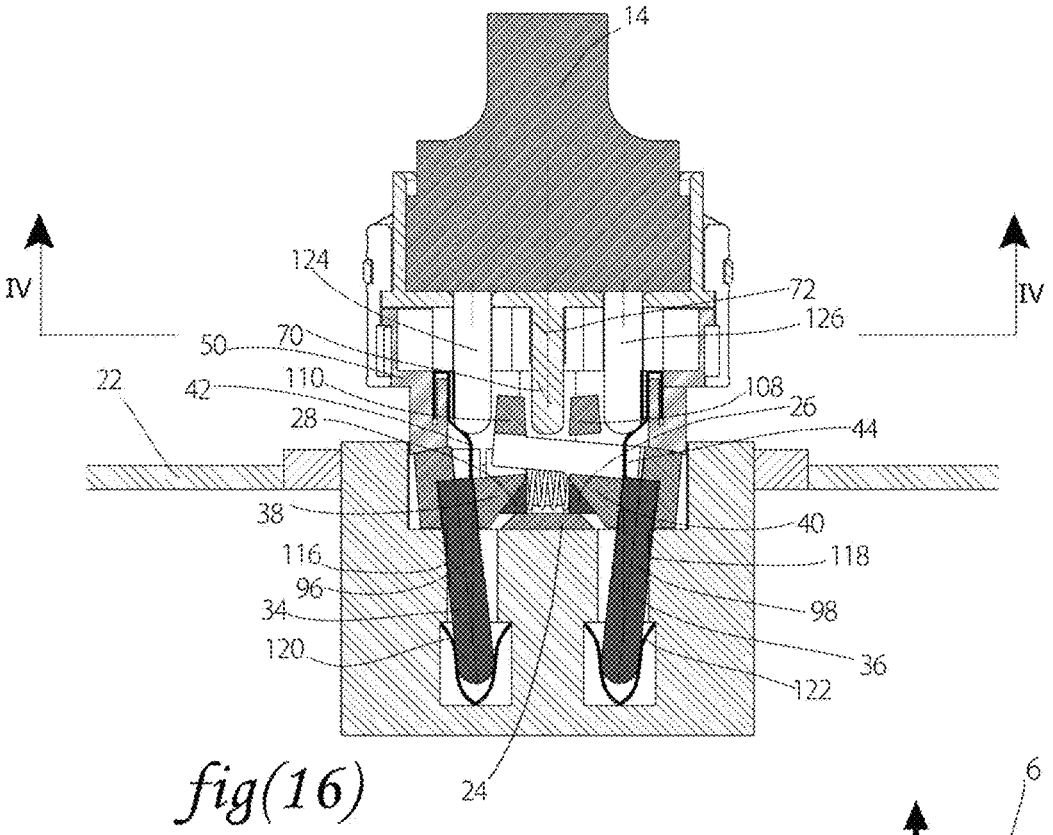
fig(16)
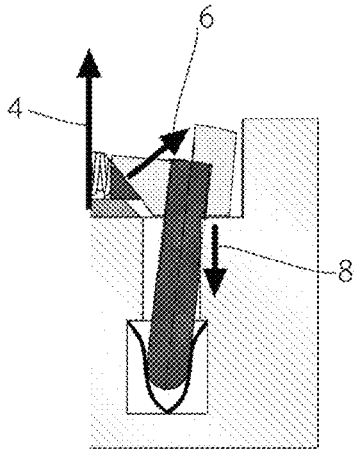
fig(16a)
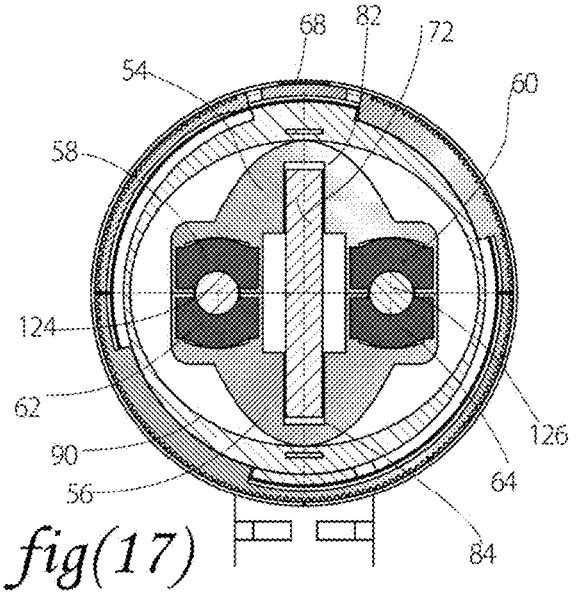
fig(17)

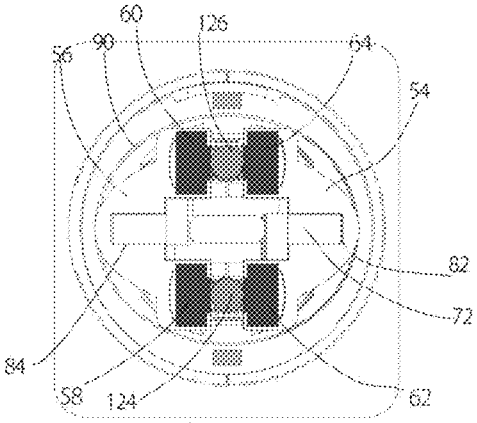
fig(18)
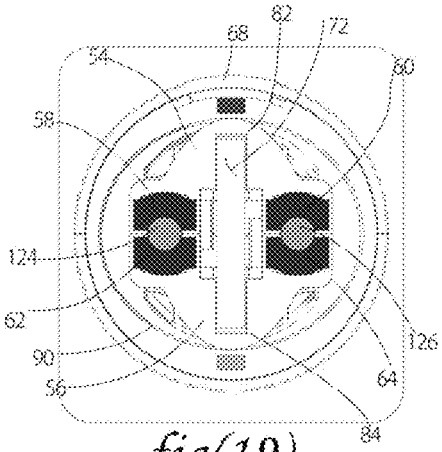
fig(19)
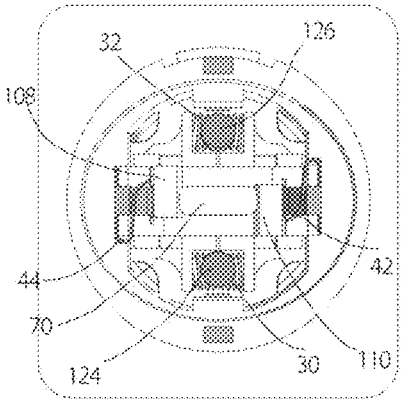
fig(20)
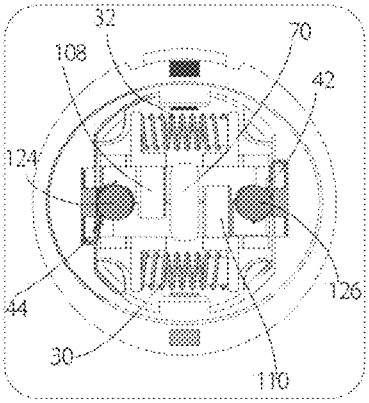
fig(21)
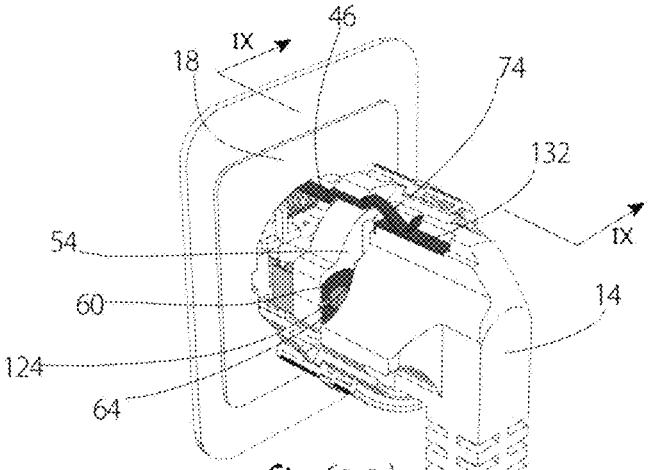
fig(22)
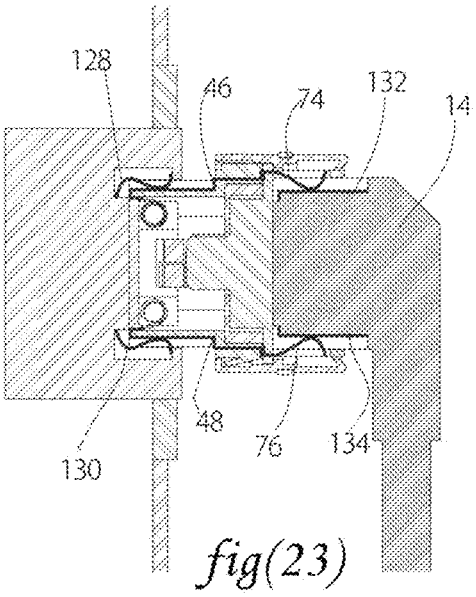
fig(23)

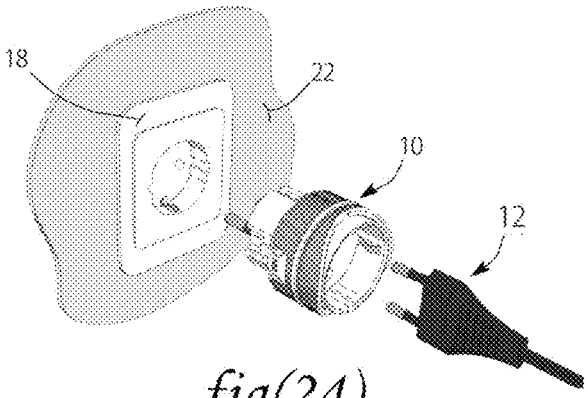
fig(24)
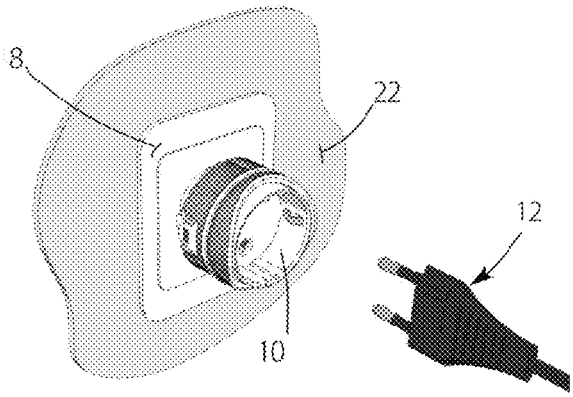
fig(25)
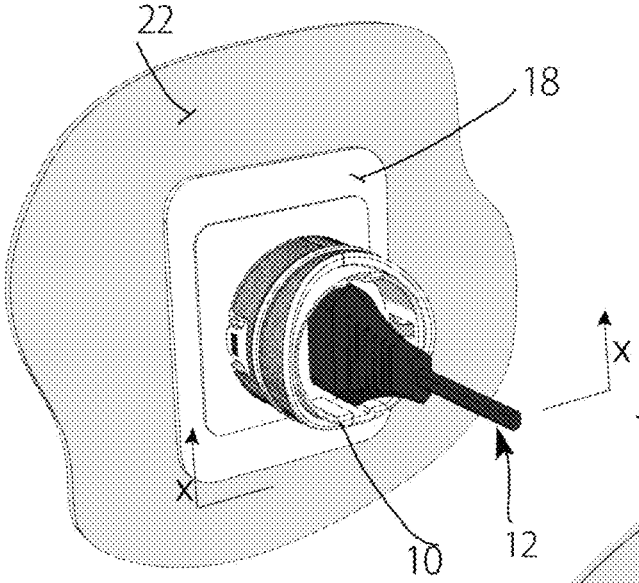
fig(26)
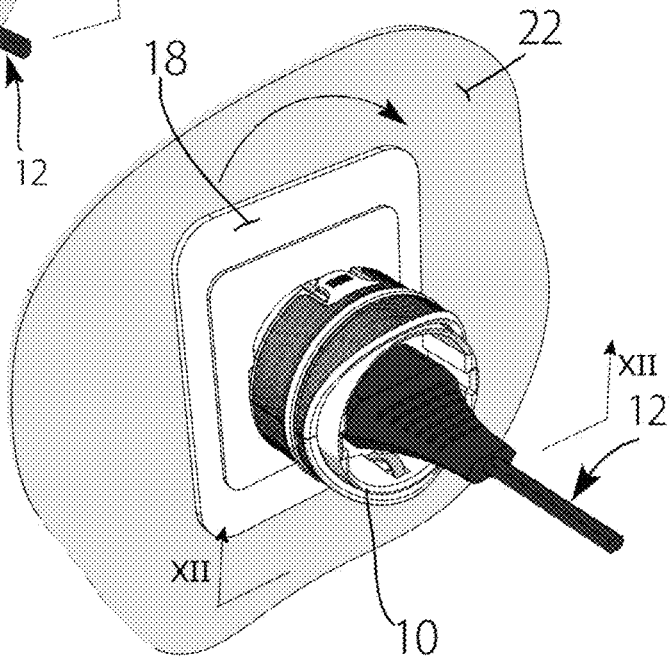
fig(27)

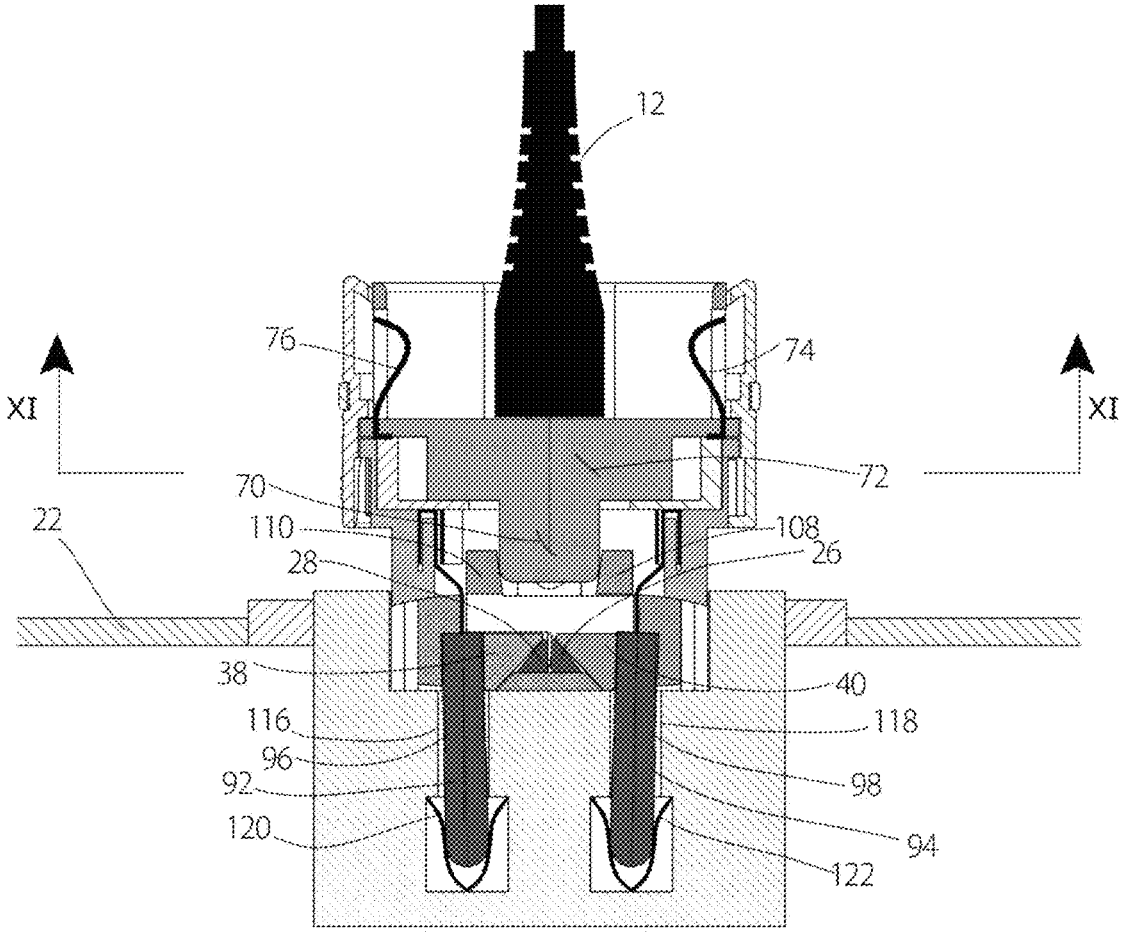
fig(28)
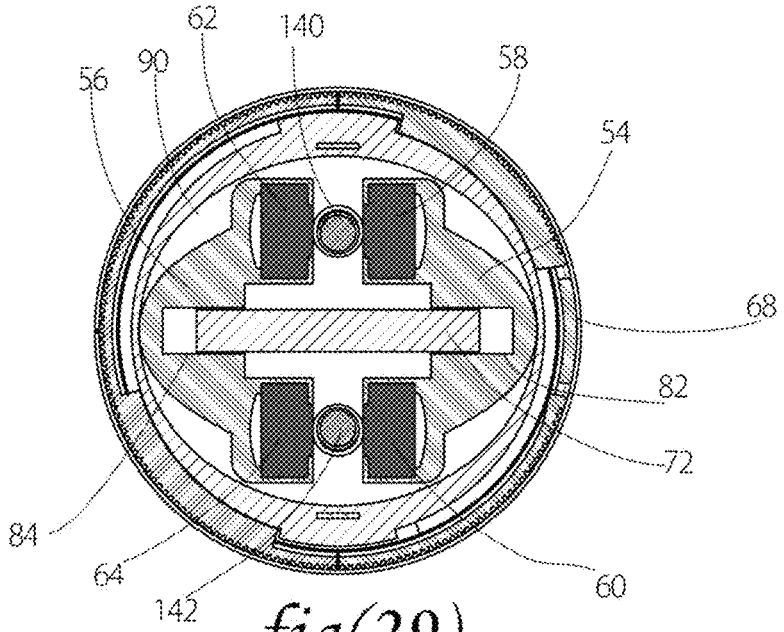
fig(29)

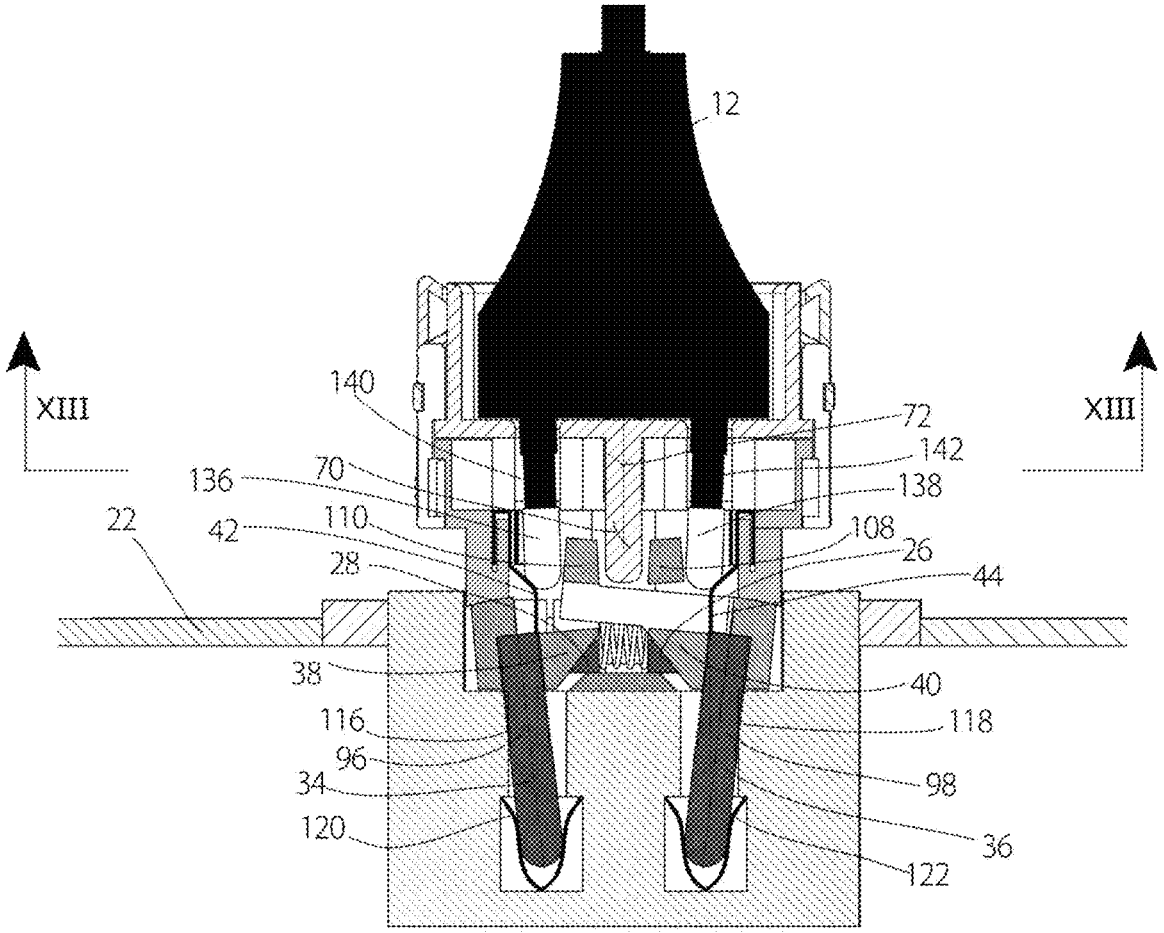
fig(30)
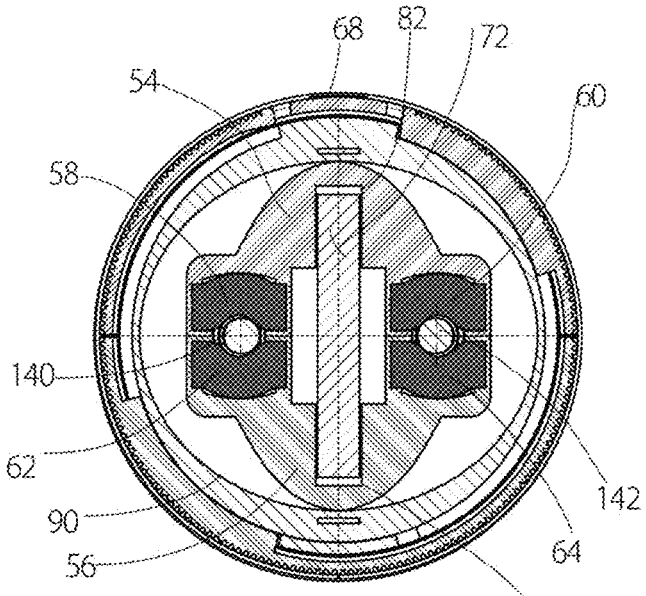
fig(31)

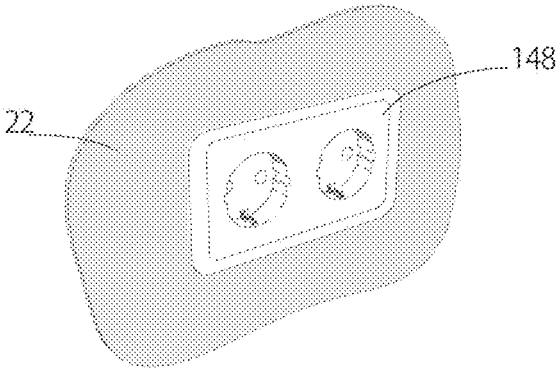
fig(32)
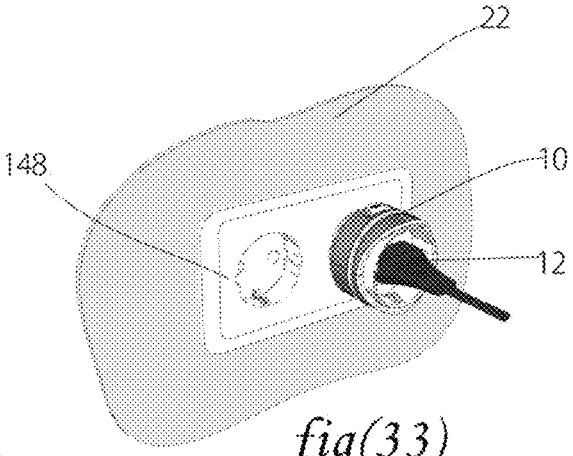
fig(33)
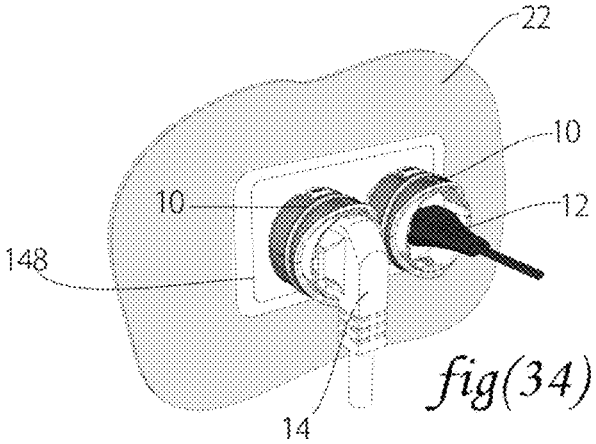
fig(34)
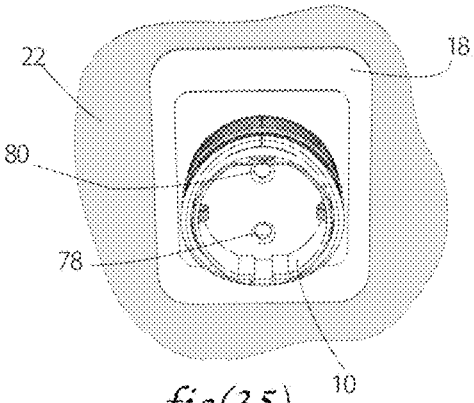
fig(35)
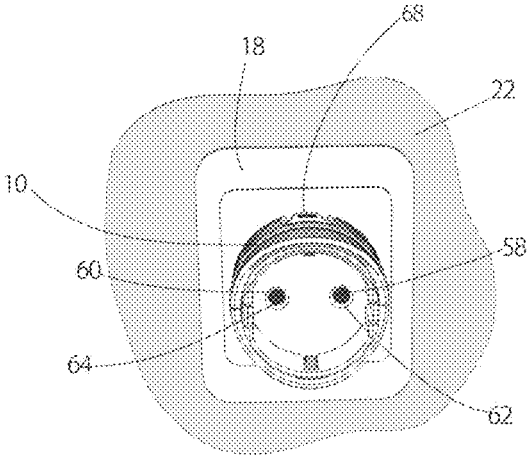
fig(36)

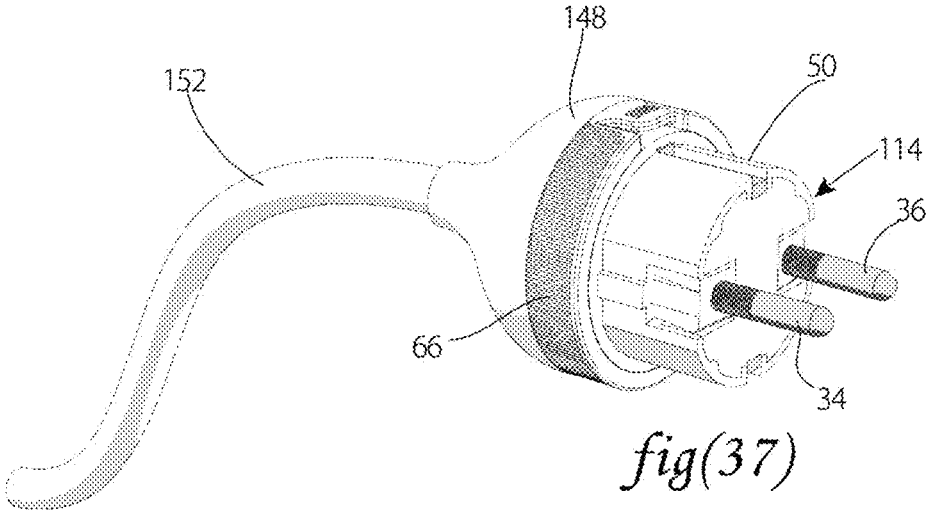
fig(37)
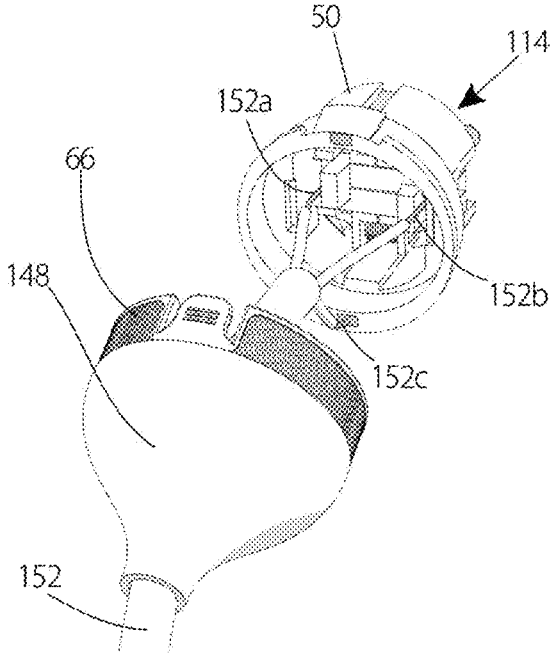
fig(38)
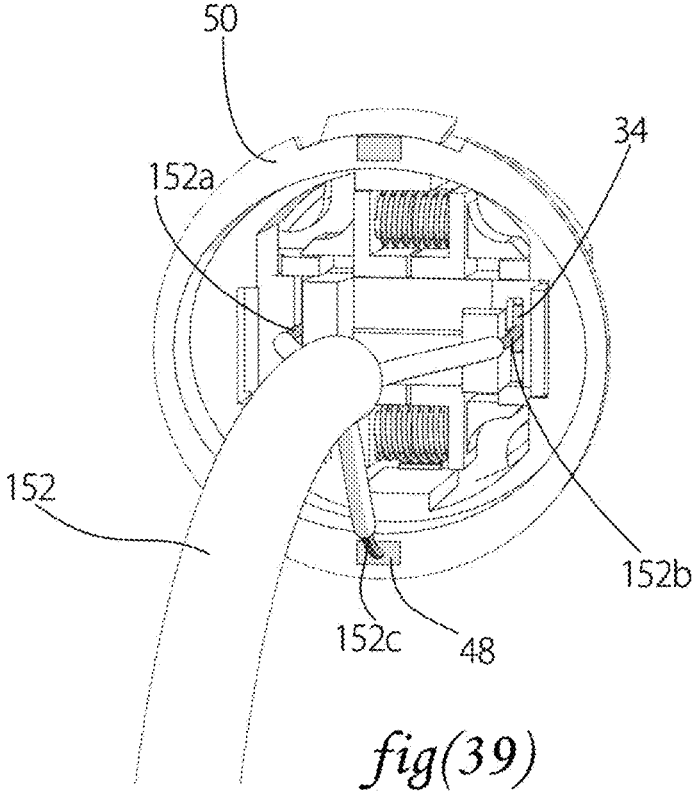
fig(39)

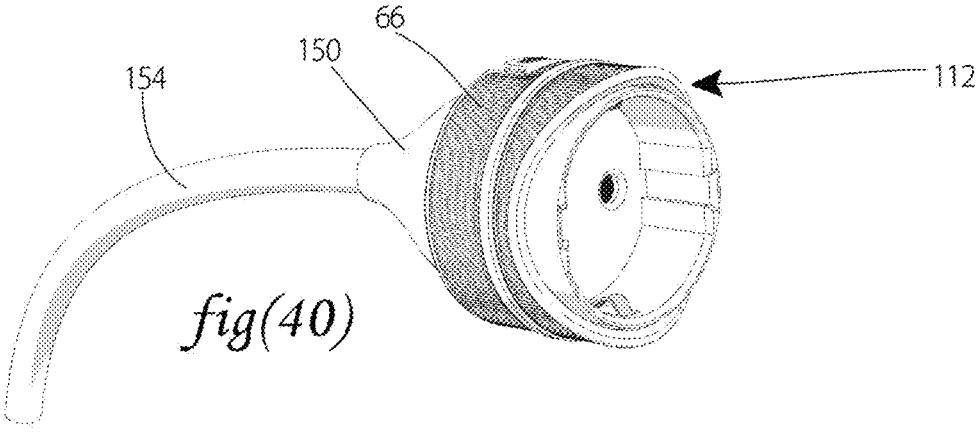
fig(40)
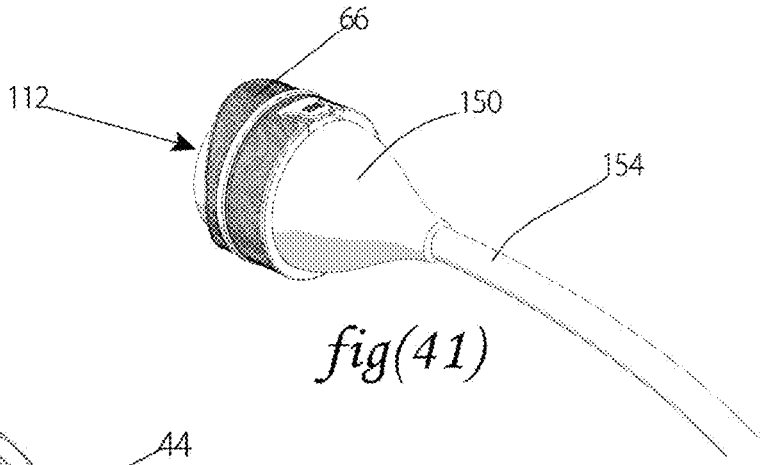
fig(41)
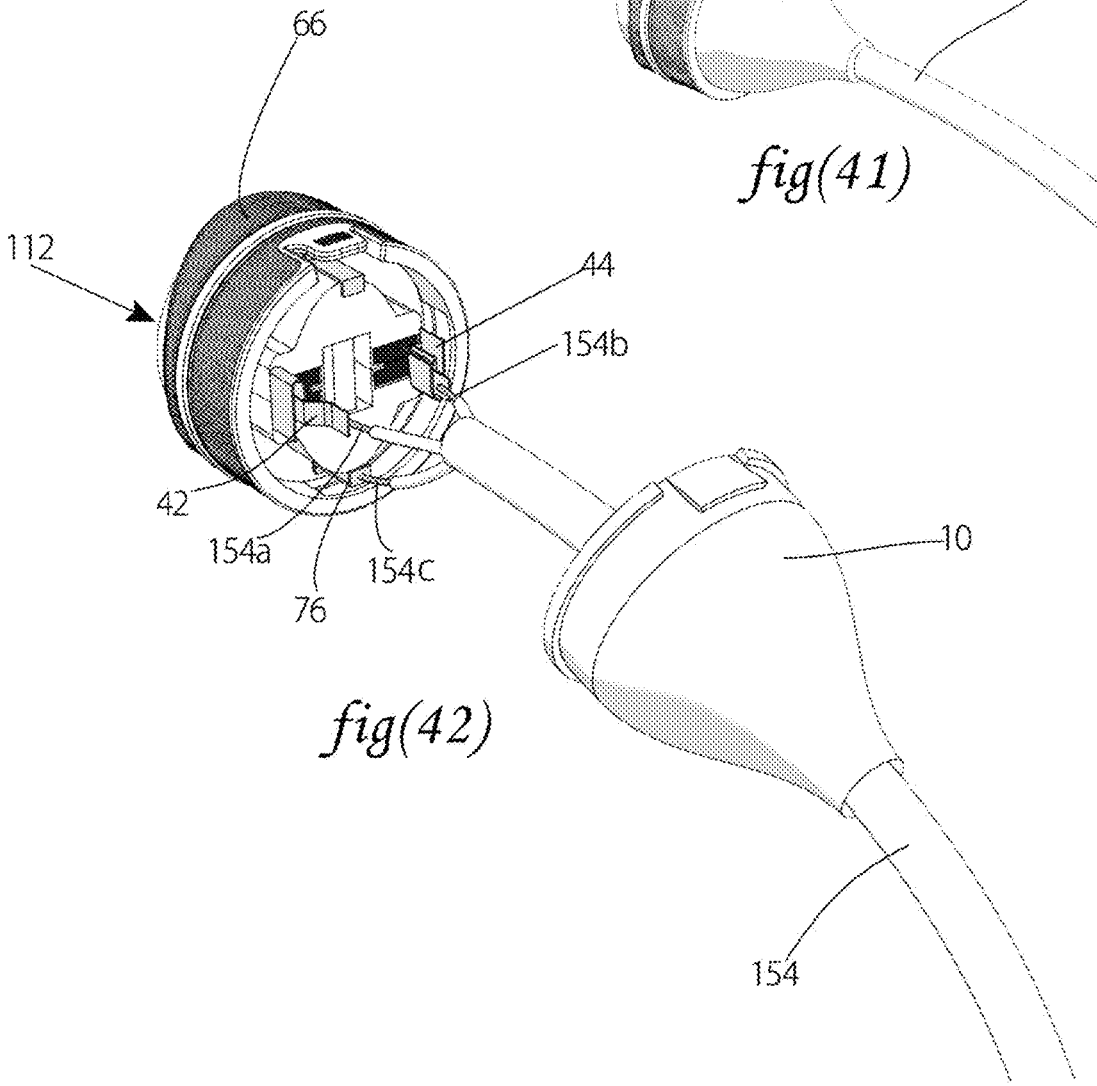
fig(42)

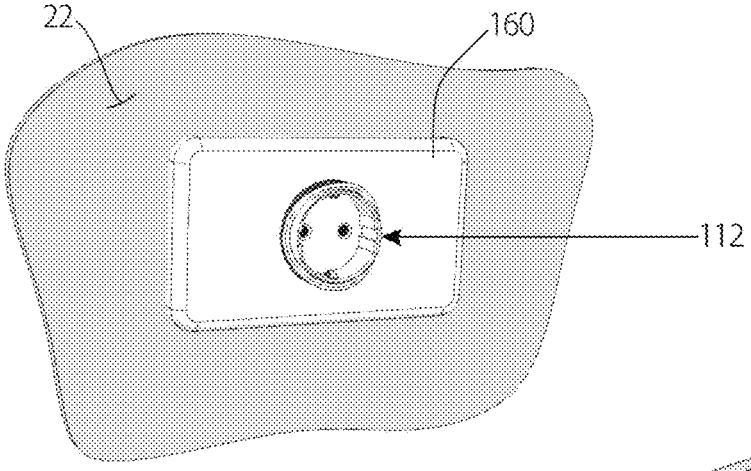
fig(43)
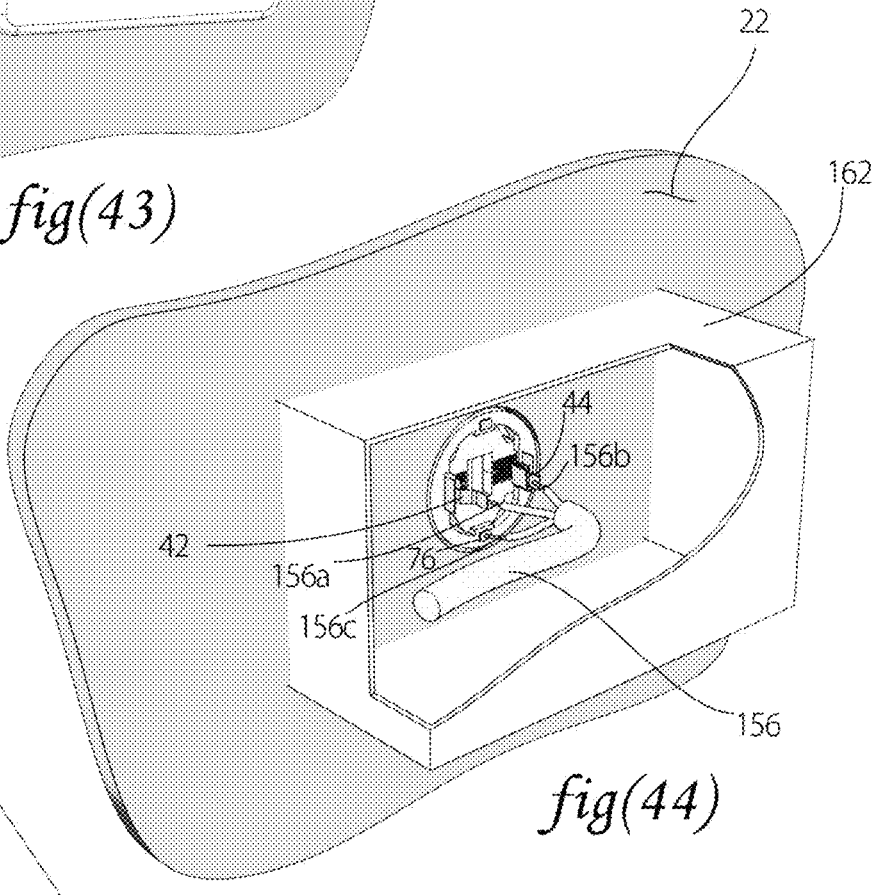
fig(44)
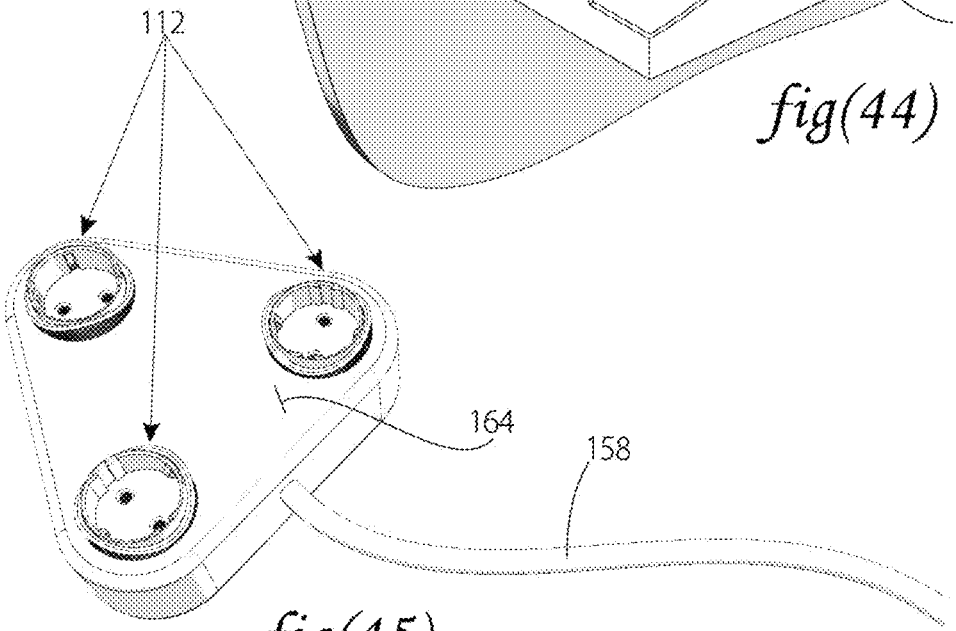
fig(45)

DEVICE AND METHOD FOR LOCKING ELECTRICAL PLUGS TO POWER OUTLETS

FIELD OF THE INVENTION

The present invention relates to electric safety. And more particularly, the invention relates to preventing electrical plugs from being removed unintentionally.

BACKGROUND OF THE INVENTION AND PRIOR ART

Electrical plugs are known to be used to provide access to the main power supply. They can be accidentally removed from the power outlets if the power cord or the plug is accidentally pulled either by person, child, pet, or by moving the attached device. In the case where the electrical plug is totally removed from the power outlet, an undesirable power cut off will occur. However, the most dangerous case is when the plug is partially pulled out while remaining electrically connected. In such case, the plug prongs are exposed, loose and badly connected. This may cause electric sparks, fire and, if touched, they can cause electric shock to a child or a pet playing around.

There can also be a serious danger when the electrical plug is not installed in the electrical outlet. Consider someone, especially children, inserting a conductive object (e.g. metallic) or a plug into the power outlet. Both cases may lead to an electrical shock. Especially if the plug is partially inserted and parts of the prongs are exposed.

Various methods and devices have been proposed to ensure engagement between electrical plugs and power outlets and hence prevent accidental disengagement. Additionally, there are several devices used for blocking the power outlet bores to prevent insertion of any object therein.

A number of patents are concerned with providing a cover for the power outlet to protect children from inserting objects therein. For example: U.S. Pat. Nos. 7,652,210, 6,108,178, 6,674,003, US2007/0256850, U.S. Pat. Nos. 7,056,145, 2,709,198, 2,987,909, 3,467,763, 4,584,856, 4,674,813, 5,061,199, 3,159,446, 4,603,931, 6,479,749, 4,603,931, 6,908,502, US2002/0118498, U.S. Pat. Nos. 6,780,031, 3,775,729, 3,491,327, 5,599,196, 6,198,046, 5,791,931, 5,286,213 and 5,791,931.

Few patents suggested preventing the unintentional removal of electrical plugs through replacing the plug and the power outlet with a custom-designed set of a plug and a receptacle that can be locked together. For example: U.S. Pat. Nos. 6,358,076, 5,344,333 and 3,121,599.

Other patents use cord fixing mechanisms to overcome the unintentional removal. For example: U.S. Pat. Nos. 6,071,142, 6,491,539, US2013/183855, U.S. Pat. Nos. 4,652,069, 4,702,709, 4,851,612, 5,348,495, 5,575,677, 5,655,924, 6,071,142, 6,095,846, 6,491,539, 6,769,930, 7,014,493, 7,056,145, and 7,722,380.

There are also patents which use a hooking mechanism to lock plugs with holed bladed prongs. These mechanisms comprise hooks that protrude through the holes in the bladed prongs. For example: U.S. Pat. Nos. 2,732,531, 3,891,289, 5,551,884, 5,194,013, 5,893,772, 5,941,724, 6,193,539, 6,454,576, 7,080,889, 7,172,451, 7,361,045, 7,484,986, US2003/0207606, US2010/0144187, U.S. Pat. Nos. 3,066,276, 3,233,204, 2,771,590, 2,016,755, 6,537,089 and 1,957,773.

U.S. Pat. No. 8,152,554 and US2005/0101169 proposed a concept for locking the electrical plug using the withdrawal force (tending to remove the plug) and converting it to a clamping force that prevents the plug from being removed.

Patent US2005/186828 provides a plug locking mechanism through applying a deflection force in a direction perpendicular to the length of the plug blade causing the plug to selectively clamp within the socket.

A concept of locking a plug inside a power outlet by clamping the plug prongs using two individual clamps has been proposed in Patent CN202737177U.

In Patent EP2639895A1 locking a plug to a power outlet is done by a retaining element provides a form of friction to the body of the plug.

Further patent proposed a terminal locking mechanism so that, the terminal contacts will have the ability to lock the electric plug therein by clamping on the plug prongs. For example: U.S. Pat. No. 7,156,682B1, CN201667452U, U.S. Pat. Nos. 6,533,598, 7,156,682B1, US 2005/0186828A1 and US 2010/0255708A1.

Finally, some patents proposed modifying the prongs of the electrical plugs with a hooking mechanism that can hook into the cavity inside the power outlet bores. For example: US2005/0124200, U.S. Pat. No. 6,171,129, US2009/0061667, and U.S. Pat. No. 7,798,838.

Although all previous patents have presented solutions to protect electrical plugs and power outlets, each has its own drawback making it a less effective solution in most cases.

Covering the power outlet protects only from insertion of objects but does not protect the electrical plug from being removed unintentionally. Removal of covers and caps may require a special tool every time before using the power outlet. Hence, it is an impractical solution for the power outlets that are used frequently.

Other solutions that required a replacement of the electrical plug and the power outlet are not practical. This is because it is not feasible to replace every plug and outlet.

Additionally, installing a fixation mechanism to hold the cord in place is not ideal in most cases as these mechanisms are bulky and designed to fit in specific types of power outlets.

Modifying the power outlet with a locking mechanism that hooks into holes of the plug prongs is a good solution. However, it is only valid for specific types of plugs that have holes in its prongs. Hence, the mechanism does not work with any other types of plugs.

While a more general solution is presented by those patents that convert the withdrawal force to a clamping force, it still has several defects such as that the clamping force is a reaction coming after moving the plug, this means that the withdrawal force must be applied and the electrical plug must be partially pulled out prior to activating the clamping mechanism. Such movement of the plug can break the electrical connection. Even if the movement is too small to break the connection, a portion of plug prongs will be exposed and electrically connected, increasing hazards of electrical shock if anyone is playing around.

Applying a permanent deflection force in a direction perpendicular to the length of the plug blade will guarantee locking the plug. However, the applied permanent force may cause a deformation to the prongs or the outlet bores. Moreover, the deflection force is unrelated to the plug pulling force meaning that a higher pulling force can overcome the deflection force and withdraw the plug.

Clamping the plug prongs using two individual clamps has many drawbacks. The individual clamps are actuated by hand, they further do not have a defined locking position. In this case the clamping force is not defined and it depends on the user hand power which may be too low to lock the plug or. Further if one clamp is pressed more than the other, the clamping force will not be symmetric around the prongs therefore the prongs will be bent. Deflecting, bending or moving the plug prongs increases the probability of bad contact and the resulting spark or fire.

Interlocking the plug by providing friction on the plug body outer surface can be used in few types of plugs whose bodies sink in the power outlet.

Those patents which modified the terminals with a locking mechanism have introduced a critical concept. The terminal contacts are the means of electric power transmission; therefore, terminals surfaces have to be clear and safe. Modifying the terminal with a locking mechanism makes it more complicated and decreases its reliability over time.

Modifying the electrical plug with a mechanism to hook into the cavity inside the power outlet does not practically work with most of the power outlets. This is due to the fact that not all outlets have a cavity inside to hook into. Even if outlets have a cavity inside, cavities do not typically have the same depth and dimensions which makes the provision of a universal hooking mechanism capable of hooking into all types of power outlets very difficult.

None of the previous inventions and patents, taken either singly or in combination, is seen to describe the instant invention as claimed. Hence, the inventor of the present invention proposes to resolve and surmount existent technical difficulties to eliminate the aforementioned shortcomings of prior art.

SUMMARY OF THE INVENTION

The present invention is a device and a method that can be used to protect electrical plugs from being removed or partially withdrawn accidentally or unintentionally. This invention is also capable of blocking power outlets, and hence, prevents insertion of any object or plug therein.

The present invention provides a solution for all types of electrical plugs and power outlets. Even, the rounded prongs types. The present invention is universal. It is capable of protecting all shapes and standards of electrical plugs including types (A), (E), (C) and (F) as well as chargers and adapters of any size. Furthermore, it fits in all shapes and standards of power outlets including types (A), (E), (C), (F) and the combined (C-A).

The present invention allows adults to install, lock, unlock, remove and reinstall the electrical plug rapidly without any need for tools or modifications to neither the power outlet nor the plug.

There are several uses of the present invention. For example, it can be used in two ways in the childproofing sector. First, if no plug is installed, the present invention can be used as a tamper resistant as it blocks the power outlet bores and prevents children from inserting any objects inside the outlet causing electric shocks. Second, if the electrical plug is installed, the present invention is capable of preventing partial or full removal of the plug and hence avoids the fatal electric shock possibility which can happen if a child puts his/her finger or an object between the socket and the loosened plug.

There are many potential users that can benefit from the present invention. In computer safety, it can be used to prevent unintentional power outages during long and continuous processing. At home, it can be used to ensure continuous electric feed to home appliances such as vacuum cleaners, refrigerator, etc. More importantly, it can be used to guarantee uninterrupted power supply to medical devices in hospitals and equipment in factories.

There are three embodiments of this invention. Each has its features which widely increase the scope of work of the present invention within different fields and applications.

The first embodiment of this invention is a universal adapter that connects power outlets and electrical plugs. This adapter has locking and unlocking positions. It has two sides. The first side contains a male electric connector that can be inserted and anchored in power outlets. The second side contains a locking receptacle that is able to receive and lock electrical plugs therein. As such, by very easy and straightforward steps, a user can connect and securely lock electrical plugs to power outlets without any further modifications to any of them.

The second embodiment of this invention is a lockable electrical plug that can be used as a conventional plug. Additionally, it can be locked in a power outlet when required.

The third embodiment of this invention is a locking receptacle able to receive electrical plugs in a similar fashion to conventional receptacles but with the further capability of locking the electrical plug therein. The locking receptacle can be found in different configurations such as power outlets, power extensions and power hubs.

BRIEF DESCRIPTION OF THE DRAWINGS

A clear understanding of the key features of the invention summarized above may be had by reference to the appended drawings which illustrate the method and device of this invention. These drawings depict preferred embodiments of the invention and, therefore, are not to be considered as limiting its scope with regard to other embodiments which the invention is capable of contemplating.

FIG. 1 a perspective view of the first embodiment of the invention between plugs and power outlets.

FIG. 2 a back perspective view of the first embodiment of the invention.

FIG. 3 a front perspective view of the first embodiment of the invention.

FIG. 4 a back fully exploded view of the first embodiment of the invention.

FIG. 5 a front fully exploded view of the first embodiment of the invention.

FIG. 6 a front exploded perspective view of the receptacle of the first embodiment of the invention.

FIG. 7 a back exploded perspective view of the receptacle of the first embodiment of the invention.

FIG. 8 a back exploded perspective view of the male connector of the first embodiment of the invention.

FIG. 9 a front exploded perspective view of the male connector of the first embodiment of the invention.

FIG. 10 a perspective view of the first embodiment of the invention between a plug type (F) and a power outlet type (F).

FIG. 11 a perspective view of the first embodiment of the invention installed in the power outlet.

FIG. 12 a perspective view showing a plug type (F) installed and unlocked.

FIG. 13 a perspective view showing a plug type (F) installed and locked.

FIG. 14 a side sectional view showing, the plug type (F) installed and unlocked, taken along lines I-I of FIG. 12.

FIG. 15 a front sectional view showing, the plug type (F) installed and unlocked, taken along lines II-II of FIG. 14.

FIG. 16 a side sectional view showing, the plug type (F) installed and locked, taken along lines III-III of FIG. 13.

FIG. 16*a* a side detail view showing, the force distribution on the male connector.

FIG. 17 a front sectional view showing, the plug type (F) installed and locked, taken along lines IV-IV of FIG. 16.

FIG. 18 a front sectional view showing, the jaws in the unlock position, taken along lines V-V of FIG. 12.

FIG. 19 a front sectional view showing, the jaws in the lock position, taken along lines VI-VI of FIG. 13.

FIG. 20 a front sectional view showing, the plug prongs at the unlock position and prongs are not connected to terminal contact, taken along lines VII-VII of FIG. 12.

FIG. 21 a front sectional view showing, the plug prongs at the lock position and prongs are connected to terminal contact, taken along lines VIII-VIII of FIG. 13.

FIG. 22 a cut in plug type (F) showing the ground connection.

FIG. 23 a side sectional view showing, the two ground connections of plug type (F), taken along lines IX-IX of FIG. 22.

FIG. 24 a perspective view of the first embodiment of the invention between a plug type (C) and a power outlet type (F).

FIG. 25 a perspective view of the first embodiment of the invention installed in the power outlet.

FIG. 26 a perspective view showing, the plug type (C) installed and unlocked.

FIG. 27 a perspective view showing, the plug type (C) installed and locked.

FIG. 28 a side sectional view showing, the plug type (C) installed and unlocked, taken along lines X-X of FIG. 26.

FIG. 29 a front sectional view showing the plug type (C) installed and unlocked, taken along lines XI-XI of FIG. 28.

FIG. 30 a side sectional view showing, the plug type (C) installed and locked, taken along lines XII-XII of FIG. 27.

FIG. 31 a front sectional view showing, the plug type (C) installed and locked, taken along lines XIII-XIII of FIG. 30.

FIG. 32 a perspective view showing, a power outlet type (F) with two outlets.

FIG. 33 a perspective view showing, the first embodiment locking a plug type (C) to a power outlet.

FIG. 34 a perspective view showing, two first embodiments locking two plugs to two power outlets.

FIG. 35 a front perspective view showing, the first embodiment of the invention installed and unlocked into a power outlet and its openings are open.

FIG. 36 a front perspective view showing, the first embodiment of the invention locked into the power outlet and its openings are blocked.

FIG. 37 a perspective view showing, the second embodiment of this invention.

FIG. 38 a perspective view showing, the second embodiment opened to show the connection between its terminal contacts and the electric cable.

FIG. 39 a perspective view showing, further details of the second embodiment electrical connection.

FIG. 40 a front perspective view showing, the third embodiment of this invention connected to an electric cable.

FIG. 41 a rear perspective view showing, the third embodiment of this invention connected to an electric cable.

FIG. 42 a perspective view showing the third embodiment opened and connected to an electric cable.

FIG. 43 a front perspective view showing, the third embodiment mounted to the wall by a mounting means.

FIG. 44 a rear perspective view showing the third embodiment mounted to a wall and connected to the in-wall electrical wires.

FIG. 45 a perspective view showing the third embodiment within a hub means.

DETAILED DESCRIPTION OF THE INVENTION

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising", when used in this specification, specify the presence of stated features, steps, operations, elements, and/or components, but do not preclude the presence or addition of one or more other features, steps, operations, elements, components, and/or groups thereof.

| Drawings Reference Numerals: | |
|---|---|
| 4 | Withdrawal Force |
| 6 | Inclined Force |
| 8 | Friction Force |
| 10 | The First Embodiment |
| 12 | Electrical Plug Type (C) |
| 14 | Electrical Plug Type (F) |
| 16 | Power outlet Type (C-A) |
| 18 | Power outlet Type (F) |
| 20 | Power outlet Type (C) |
| 22 | Wall |
| 24 | Base Plate |
| 26, 28 | Pusher |
| 30, 32 | Spring |
| 34, 36 | Special Pin |
| 38, 40 | Leg |
| 42, 44 | Terminal contact |
| 46, 48 | Stationary Ground Contact |
| 50 | Assembling shell |
| 52 | Security Lip |
| 54, 56 | Jaw |
| 58, 60, 62, 64 | Friction Pad |
| 66 | Rotatable Sleeve |
| 68 | Security Button |
| 70 | Legs Guide Fin |
| 71 | Receptacle Housing |
| 72 | Jaws Guide Fin |
| 74, 76 | Rotatable Ground Contact |
| 78, 80 | Aperture |
| 82, 84 | Groove |
| 86, 88 | Smooth Tip |
| 90 | Oval cam |
| 92, 94 | Smooth Metallic Portion |
| 96, 98 | High Friction Portion |
| 100, 102 | Pusher's Inclined Surface |
| 104, 106 | Legs Inclined Surface |
| 108, 110 | Paddle |
| 112 | Locking Receptacle |
| 114 | Male connector |
| 116, 118 | Bore |
| 120, 122 | Clip |
| 124, 126 | (F) Plug Metallic prong |
| 128, 130 | (F) Power outlet Earth Clip |
| 132, 134 | (F) Plug Earth Clip |

-continued

| Drawings Reference Numerals: | |
|---|---|
| 136, 138 | (C) Plug Metallic prong |
| 140, 142 | (C) Plug Insulated prong |
| 148, 150 | Back Shell |
| 152, 154, | Cable |
| 156, 158 | Cable |
| 160 | Wall Mounting means |
| 162 | Electric Box |
| 164 | Power Hub |
| 152a, b, c | Wire Terminal |
| 154a, b, c | Wire Terminal |
| 156a, b, c | Wire Terminal |

In the description which follows, the drawings are not necessarily to scale and, in some instances, proportions have been exaggerated in order to allow clearer depiction of certain features of the invention.

FIGS. 1 to 36 illustrate the components and methods of use of the first embodiment of this invention as follows:

FIG. 1 shows the first embodiment (10) between the electrical plug type (C) (12) and type (F) (14) and the wall outlets type (C) (20), type (F) (18) and the combined type (C-A) (16).

As shown in FIG. 2 and FIG. 3, the first embodiment comprises two sides. The first is an axially rotatable locking receptacle (112) that can receive and lock electrical plugs therein. The second side is a male connector (114) with two special pins (34), (36) which is able to be inserted and anchored in power outlets. Both sides are assembled to the assembling shell (50).

Components of the first embodiment are exploded in FIG. 4 and FIG. 5. These Components are divided into three main parts, a locking receptacle (112), a male connector (114), and an assembling shell (50).

The male connector (114) comprises a base plate (24) and two pushers (26), (28) which are separated away by two springs (30), (32). The two springs are preloaded so they always force pushers (26), (28) to move outward. The two legs (38), (40) hold the two special pins (34), (36) and connect them to the two terminals (42), (44). The stationary ground contacts (46), (48) are fixed to the assembling shell (50).

The locking receptacle (112) comprises a receptacle housing (71) and two clamping jaws (54), (56). Each jaw has two friction pads (58), (60) and (62), (64). The locking receptacle also comprises a rotatable sleeve (66), a security button (68), a jaws guide fin (72), a legs guide fin (70) and two rotatable ground contacts (74), (76).

The locking receptacle (112) illustrated in FIG. 6 and FIG. 7 is the key responsible for fixing and locking electrical plugs. It comprises a rotatable sleeve (66) and two clamping jaws (54), (56). The rotatable sleeve (66) contains two rotatable contacts (74), (76) which connect ground line to the plug earth clips. Additionally, it comprises two apertures (78), (80) that plug prongs are inserted in. Also, it has jaws guide fin (72) and legs guide fin (70). Further, it has a security button (68). Each jaw (54) and (56) contains two friction pads (58), (60) and (64), (62) respectively. These pads could be rubber, silicon or any other material which has a high friction coefficient. Jaws guide fin (72) guides jaws (54), (56) through grooves (82), (84) so that the jaws (54), (56) are able to slide radially and rotate with the jaws guide fin (72). Each jaw (54), (56) has its smooth tip (86), (88) which can slide freely inside the oval cam (90) of the assembling shell (50).

FIG. 8 and FIG. 9 illustrate the male connector which is responsible for anchoring in the power outlet circular bores. Pins (34), (36) are specially made for the purpose of generating a high friction so each pin has a smooth metallic portion (92), (94) and a high friction portion (96), (98) which may be rough, textured or coated by a high friction material. The two special pins (34), (36) are fixed to an anchoring mechanism which comprises two legs (38), (40), each leg has an inclined smooth surface (104), (106) and a paddle (108), (110). Legs inclined surfaces (104), (106) are adjacent to Pushers inclined smooth surfaces (100), (102) so they can slide freely over each other. Pushers (26), (28) are subjected to an outward force exerted by two preloaded springs (30), (32). The outward force is transmitted to legs (38), (40) through the pushers inclined smooth surfaces (100), (102)

FIG. 10 through FIG. 13 are showing the process of fixing and locking an electric plug type (F) to a power outlet type (F). FIG. 10 illustrates the arrangement of the power outlet (18), the first embodiment (10) and the electrical plug (14). In FIG. (11), the first embodiment (10) is inserted in power outlet (18). In FIG. 12 the plug (14) is inserted in the other side of the first embodiment (10). By turning either the rotatable sleeve (66) or the plug (14) 90 degrees clockwise, the three members power outlet (18), the first embodiment (10) and the electrical plug (14) will be all fixed together and locked and the electric power will be connected to the plug (14). In FIG. 13, electrical plug (14) is fixed and locked in place with the power outlet (18) so it cannot be turned or pulled out. To unlock and remove the electrical plug (14), the security button (68) must be pressed then either the rotatable sleeve (66) or the plug (14) must be turned 90 degrees counterclockwise.

FIG. 14 and FIG. 15 are sectional views which provide further illustration of the first embodiment (10) unlocked and connected to the power outlet (18) and the electrical plug (14). As shown in FIG. 14, the first embodiment is in the unlock position and the male connector is free to slide in and out within the outlet bores (116), (118). That is because the legs guide fin (70) is preventing any movement of the paddles (110), (108). Consequently, legs (38), (40) are fixed in place against pushers (26), (28). Therefore, pins (34), (36) are aligned with the outlet bores (116), (118). So, they can be inserted or removed easily without touching the surface of bores (116), (118).

FIG. 15 shows plug prongs (124), (126) between the two clamping jaws (54), (56) and four friction pads (58), (60), (62), (64). When the device is in the unlock position, jaws guide fin (72) directs the two jaws (54), (56) to be aligned with the major diameter of the oval cam (90) so these four friction pads (58), (60), (62), (64) are uncompressed and plugs pins (124), (126) are free to move in and out.

FIG. 16 and FIG. 17 are sectional views taken in FIG. 13 which demonstrate the first embodiment in the lock position and how it fixes plug and power outlet together. In FIG. 16, a side sectional view showing how the plug prongs (124), (126) are connected to the power outlet clips (122), (120) through terminal contacts (42), (44) and special pins (34), (36). FIG. 16 is further demonstrate the anchoring mechanism that consists of springs (30), (32), pushers (26), (28) and legs (38), (40). This anchoring mechanism is responsible of fixing the male connector (114) in the power outlet (18). The anchoring mechanism is controlled through the leg guide fin (70) which, when rotated 90 degrees, frees the legs (38), (40) to move outward by the two springs (30), (32). This outward movement pushes the two special pins (34), (36) against the outlet bores (116), (118). Therefore, An Initial friction Force is generated between the sides of outlet bores (116), (118) and the pins high friction portions (96), (98). This initial friction force fixes the male connector (114) in the power outlet (18).

When a withdrawal force is applied to the plug (14) or the first embodiment (10), the anchoring mechanism will increase the friction force between the outlet bores (116), (118) and the pins high friction portions (96), (98) to prevent withdrawal of the plug (14) and the first embodiment (10).

FIG. 16*a*) illustrates the working principle of the anchoring mechanism when a withdrawal force (4) is applied. The withdrawal force is transmitted to the base plate (24) through assembling shell (50). The base plate (24) transmits the withdrawal force (4) to pushers (26), (28). The inclined surface between pushers (26), (28) and legs (38), (40) will divert the withdrawal force (4) to the inclined force (6). This inclined force (6) will increase the pressure on the special pins (34), (36) which increases the friction force (8) proportionally.

FIG. 17 is showing plug prongs (124), (126) clamped with friction pads (58), (60), (62), (64). These pads are compressed because the clamping jaws (54), (56) are rotated and aligned with the minor diameter of the oval cam (90). Both jaws apply equal forces on the opposite sides of plug prongs (124), (126). The symmetry of forces applied on the prongs (124), (126) produces a pure clamping force without any bending components. Due to this clamping force, the plug (14) will be fasten in place without deflecting, bending or moving the prongs (124), (126).

FIG. 18 and FIG. 19 are showing the plug prongs (124), (126) between friction pads (58), (60), (62), (64) while the first embodiment is in the unlocking and locking positions respectively.

FIG. 20 and FIG. 21 are showing the plug prongs (124), (126) and the terminal contacts (42), (44) in unlock and lock positions respectively. It also illustrates that the electric power is not transmitted to plug pins (124), (126) until they contact terminal contacts (41), (44) which happens only when the plug is locked.

FIG. 22 and FIG. 23 illustrate how the ground line is connected between plug earth clips (132), (134) and the power outlets earth clips (128), (130) through the rotatable ground contacts (74), (76) and stationary ground contact (46), (48).

The first embodiment of this invention (10) is also capable of fixing plug type (C) with all power outlet types as shown in FIG. 24 through FIG. 31. All the previous descriptions about plug (F) (14) are common with plug (C) (12) except that there are no earth clips in plug type (C) (12).

FIG. 32, FIG. 33 and FIG. 34 are illustrating simplicity of the first embodiment (10) which makes it capable of fitting in a multiple outlet (148) side by side with another electrical plug.

FIG. 35 and FIG. 36 show that the first embodiment can be used itself as a tamper-resistant device by installing it in the power outlet then rotating its rotatable sleeve (66) 90 degrees clockwise. Then the first embodiment (10) will be fixed and locked in place with the power outlet (18) and the two apertures (78), (80) will be blocked by the friction pads (58), (60), (62), (64). To reuse the power outlet again, the security button (68) must be pressed then rotatable sleeve (66) must be rotated 90 degrees counterclockwise so the apertures (78), (80) will be open.

FIGS. 37 through 39 illustrate the second embodiment of this invention, which is a lockable electrical plug. This lockable plug comprises a male connector (114), an assembling shell (50), rotatable sleeve (66) and a back shell (148). In FIG. 38 and FIG. 39, the male connector is connected to the cable (152) through wire terminals (152*a*) and (152*b*) while the ground contact (48) is connected to the ground wire terminal (152*c*). The second embodiment of this invention can be inserted or removed from power outlets as a conventional plug while the rotatable sleeve (66) is in the unlock position. However, it can be locked in the power outlet when the rotatable sleeve (66) is rotated 90 degrees clockwise. The male connectors in the first embodiment and in the second one are identically having the same components and working principles. So, all descriptions and figures of the male connector in the first embodiment are applied to the second embodiment.

The third embodiment of this invention is another configuration of the locking receptacle (112) (described in the first embodiment). It has the same main components and working principles recited in the first embodiment descriptions and figures. With some modifications, this locking receptacle can be used as a power extension or a wall outlet.

FIGS. 40 through 45 illustrate the different configurations of the third embodiment. In FIGS. 40, 41 and 42, the first configuration comprises the locking receptacle (112) connected to an electric cable (154) to be used as a single port power extension with an extra option of locking plugs therein. FIG. 42 shows the connection between the locking receptacle (112) and the electric cable (154). Terminals contacts (42), (44) are connected to the wire terminals (154*a*), (154*b*) and the ground contact (76) is connected to the wire terminal (154*c*).

In FIG. 43 and FIG. 44, a wall outlet configuration of the third embodiment is shown. Mounting the locking receptacle (112) to the wall (22) by a mounting means (160) provides another application of the third embodiment. In this configuration the third embodiment works like a conventional wall outlet. Further, it is able to lock plugs inserted therein. In FIG. 44, the terminal contacts (42), (44) are connected to the wire terminals (156*a*), (156*b*) of the wall electrical cable (156) and the ground contact (76) is connected to the ground wire terminal (156*c*).

In FIG. 45, the third embodiment of this invention is configured as a power hub when multiple locking receptacles (112) are assembled to a power hub (164) and connected to a cable (158).

While three embodiments have been shown and described, many variations are possible. With time, additional features may be employed. The particular shape or configuration of the platform or the interior configuration may be changed to suit the system or equipment with which it is used.

Having described the invention in detail, those skilled in the art will appreciate that modifications may be made to the invention without departing from its spirit. Therefore, it is not intended that the scope of the invention be limited to the specific embodiment illustrated and described. Rather, it is intended that the scope of this invention be determined by the appended claims and their equivalents.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

What is claimed is:

1. A locking electrical receptacle (112) for receiving and releasably locking an electrical plug with any shape of prongs, comprising:

a receptacle housing having a plurality of apertures (78, 80) for receiving prongs of the electrical plug;

at least two terminal contacts (42, 44);

a clamping mechanism (54, 56, 58, 60, 62, 64) comprising movable jaws (54, 56), said clamping mechanism being mounted between said at least two terminal contacts (42, 44) and said plurality of apertures (78, 80); and an actuation means (66, 90) having locking and unlocking positions for actuating said clamping mechanism (54, 56, 58, 60, 62, 64), wherein when said electrical plug is not inserted into said receptacle housing and said actuation means (66, 90) is set to a locking position, the clamping mechanism (54, 56, 58, 60, 62, 64) blocks said plurality of apertures (78, 80) to prevent insertion of any object inside and contacting the contacts (42, 44), thus enhancing safety;

wherein when the electrical plug is inserted into said receptacle housing and said actuation means is set to said locking position, said means urges said movable jaws (54,56) to apply a clamping force onto at least one of said prongs securely fastening said electrical plug in place.

2. The locking electrical receptacle (112) of claim 1, wherein said clamping force onto at least one of said prongs is applied symmetrically to prevent bending of said prongs.

3. The locking electrical receptacle (112) of claim 1, wherein said actuation means comprises a cam (90) for switching said clamping mechanism (54, 56, 58, 60, 62, 64) between fastening and releasing said prongs.

4. The locking electrical receptacle (112) of claim 1, wherein said actuation means comprises an oval cam (90) which has long and short sides such that switching between said long and short sides shifts said clamping mechanism (54, 56, 58, 60, 62, 64) between fastening and releasing said prongs.

5. The locking electrical receptacle (112) of claim 1, wherein said movable jaws (54, 56) comprise friction pads (58, 60, 62, 64) for increasing friction between said movable jaws (54, 56) and said prongs.

6. The locking electrical receptacle (112) of claim 5, wherein said friction pads (58, 60, 62, 64) are made from elastic material.

7. The locking electrical receptacle (112) of claim 5, wherein said friction pads (58, 60, 62, 64) are made from rubber.

8. A male electrical connector (114) for being connected and releasably anchored into a power outlet to prevent unintentional withdrawal by a withdrawal force comprising:

a plurality of electrically conductive pins (34, 36) for contacting terminals of said power outlet, with at least one of said pins having a root portion with high friction surface (96, 98); and an anchoring mechanism (26, 28, 38, 40) for diverting said withdrawal force to a lateral force and transmitting said lateral force to said pins, wherein said lateral force urges said pins to angularly deflect against bores of said power outlet causing said connector to anchor within said power outlet.

9. The electrical connector of claim 8, wherein said male connector is further comprises a releasing means (70, 108, 110) for deactivating said anchoring mechanism to install or remove said connector from said power outlet.

10. An electrical adapter (10) for connecting and releasably locking an electrical plug to a power outlet and preventing said plug from being removed by withdrawal force, comprising of:

a first side having a male electrical connector (114) adapted to be inserted and releasably anchored into said power outlet comprising:

a plurality of electrically conductive pins (34, 36) for contacting terminals of said power outlet, at least one of said pins having a root portion with high friction surface (96, 98); and an anchoring mechanism (38, 40) capable of angularly deflecting at least one of said pins against bores of said power outlet causing said connector to anchor within said power outlet;

a second side having a locking electrical receptacle (112) for receiving and releasably locking said electrical plug comprising:

a receptacle housing having a plurality of apertures (78, 80) for receiving prongs of said plug; and at least two terminal contacts (42, 44) adapted to connect to said connector pins of said male connector; and a clamping mechanism (54, 56, 58, 60, 62, 64) having locking and unlocking positions, said clamping mechanism being mounted between said terminal contacts and said plurality of apertures such that in said locking position, said clamping mechanism applies a clamping force on at least one of said prongs, and in said unlocking position, said clamping mechanism releases said clamping force from said prongs making said plug free to withdraw; and an assembly means (50) for combining said first and second sides, said assembly means being structured for controlling said clamping mechanism of said locking receptacle and said anchoring mechanism of said electrical connector, wherein said assembly means is capable of synchronizing positions of said clamping mechanism and said anchoring mechanism such that both are in locking or unlocking positions simultaneously.

11. The adapter of claim 10, wherein said clamping mechanism comprises movable jaws (54, 56) having friction pads (58, 60, 62, 64).

12. The adapter of claim 11, wherein said jaws are guided by an oval cam (90) which has long and short sides such that said jaws are aligned with said short side when said clamping mechanism is in said locking position, and said jaws are aligned with said long side when said clamping mechanism is in said unlocking position.

13. The adapter of claim 10, wherein said anchoring mechanism further comprises a deflection amplifier means (26, 28, 30, 32) for diverting said withdrawal force to a lateral force and transmitting said lateral force to said pins, and wherein said lateral force increases said angular deflection of said pins thereby increasing the attachment of said pins.

14. A method for locking and unlocking an electrical plug in a power outlet, the method comprising the steps of:

providing a locking device (10) that includes a locking receptacle (112) in a first side having a clamping mechanism (54, 56, 58, 60, 62, 64) and terminal contacts (42, 44) therein, said receptacle being capable of receiving and releasably locking said electrical plug;

a male connector (114) in a second side having a plurality of deflectable conductive pins (34, 36) with at least one having high friction surface at root (96, 98), said connector pins being mounted in a movable anchoring mechanism (38, 40) which is able to radially move at least one of said pins, said male connector being capable of anchoring into said power outlet when one or more of said pins is deflected; and a body portion (50) for combining said two sides, said body being coupled with a rotatable sleeve (66) which is axially rotatable clockwise and counterclockwise for controlling said clamping mechanism and said anchoring mechanism simultaneously to lock or unlock respectively;

plugging said locking device into said power outlet such that said male connector pins are inserted into bores of said power outlet;

plugging said electrical plug into said locking receptacle in said second side of said locking device;

twisting said rotatable sleeve or said electric plug clockwise for;

connecting electric power from said power outlet to said electrical plug through said connector pins and receptacle terminals;

urging said clamping mechanism to lock said electrical plug into said locking receptacle;

urging said anchoring mechanism of said male connector to deflect at least one of said pins to anchor into said power outlet bores;

wherein said electrical plug is connected and locked into said locking receptacle and said male connector is connected and anchored into said power outlet bores;

twisting said rotatable sleeve or said electric plug counterclockwise for:

disconnecting electric power to said electrical plug;

releasing said clamping mechanism;

urging said anchoring mechanism to align said connector pins with said outlet bores;

wherein said electrical plug unlocked and able to be unplugged, and said locking device is released and able to be unplugged.

* * * * *